US007886915B2

(12) United States Patent
Shulman

(10) Patent No.: US 7,886,915 B2
(45) Date of Patent: Feb. 15, 2011

(54) METHOD FOR BULK SORTING SHREDDED SCRAP METAL

(76) Inventor: Alvin D. Shulman, 1009 Carlyle Ter., Highland Park, IL (US) 60035

( * ) Notice: Subject to any disclaimer, the term of this patent is extended or adjusted under 35 U.S.C. 154(b) by 99 days.

(21) Appl. No.: 12/326,262

(22) Filed: Dec. 2, 2008

(65) Prior Publication Data

US 2009/0236268 A1 Sep. 24, 2009

Related U.S. Application Data

(60) Provisional application No. 61/037,838, filed on Mar. 19, 2008.

(51) Int. Cl.
*B07C 5/00* (2006.01)

(52) U.S. Cl. ..... 209/552; 209/930; 241/24.13

(58) Field of Classification Search ..... 209/552, 209/576, 912, 930; 241/24.13, 24.25
See application file for complete search history.

(56) References Cited

U.S. PATENT DOCUMENTS

| | | | | |
|---|---|---|---|---|
| 3,489,901 | A * | 1/1970 | Brown | 250/308 |
| 3,748,473 | A * | 7/1973 | Chen | 250/392 |
| 4,580,684 | A * | 4/1986 | Bohme et al. | 209/549 |
| 4,582,992 | A | 4/1986 | Atwell et al. | |
| 4,830,193 | A | 5/1989 | Clayton et al. | |
| 5,180,421 | A * | 1/1993 | Rostoker et al. | 75/414 |
| 5,396,071 | A * | 3/1995 | Atwell et al. | 250/358.1 |
| 5,732,115 | A | 3/1998 | Atwell et al. | |
| 5,948,137 | A | 9/1999 | Pflaum | |
| 5,959,870 | A * | 9/1999 | Hurwitz et al. | 700/239 |
| 6,545,240 | B2 * | 4/2003 | Kumar | 209/579 |
| 6,579,339 | B1 * | 6/2003 | Jamison et al. | 75/386 |
| 7,152,002 | B2 * | 12/2006 | Lingren et al. | 702/23 |
| 7,200,200 | B2 * | 4/2007 | Laurila et al. | 378/45 |
| 7,253,414 | B2 * | 8/2007 | Osucha et al. | 250/358.1 |
| 7,513,371 | B2 * | 4/2009 | Gnedenko et al. | 209/552 |
| 2006/0115037 | A1 | 6/2006 | Pedersen et al. | |

FOREIGN PATENT DOCUMENTS

| | | |
|---|---|---|
| EP | 0059033 | 9/1982 |

OTHER PUBLICATIONS

Nijkerk, A. A. and W. L. Dalmijn, "Handbook of Recycling Techniques," 1998, pp. 88-109, 127-128, 201-202, Nijkerk Consultancy, The Hague, Netherlands.
Fischer, Theodore, "Downstream Separation Systems," *Scrap*, Nov.-Dec. 2007, pp. 113-126 (not inclusive).
"Innov-X, Omnisource Produce New Copper Extraction System," *Scrap*, Sep.-Oct. 2007, p. 29.
Achieving Purer Ferrous Shred, *Scrap*, Jan.-Feb., 2007, pp. 107-108.

(Continued)

*Primary Examiner*—Joseph C Rodriguez
(74) *Attorney, Agent, or Firm*—Marshall, Gerstein & Borun LLP

(57) ABSTRACT

A stream of shredded scrap metal is divided into increments. A bulk material analyzer is employed to determine the bulk chemical composition of each increment. The increments are then sorted on the basis of the bulk chemical composition of each increment.

29 Claims, 4 Drawing Sheets

OTHER PUBLICATIONS

Fischer, Theodore, "Don't Believe Your Eyes," *Scrap*, Nov.-Dec., 2006, pp. 71-78 (not inclusive).

Woodward, Richard, et al., "Automated Coal Blending with Two Control Parameters at One of Arch Coal's West Virginia Mining Complexes," International On-Line Coal Technical Conference, St. Louis, Mo., Nov. 8-10, 2004, http://www.thermo.com/e_Thermo/cma/PDFs/Various/File_24617.pdf.

Metals Handbook, Desk Edition, 1995, pp. 4-8 to 4-53 (not inclusive) 7-10 and 7-11, American Society for Metals, Metals Park, Ohio.

* cited by examiner

METHOD FOR BULK SORTING SHREDDED SCRAP METAL

CROSS-REFERENCE TO RELATED APPLICATION

This application claims the benefit of U.S. Provisional Application No. 61/037,838, filed Mar. 19, 2008, and the disclosure thereof is incorporated herein by reference.

FIELD OF THE INVENTION

The present invention relates generally to the processing of scrap metal and more particularly to the processing of shredded scrap metal.

BACKGROUND OF THE INVENTION

Shredded scrap metal is produced typically by feeding obsolete or discarded articles of metal (i.e., scrap metal) into an apparatus called a shredder in which the scrap metal is flailed, by rotating, free-swinging hammers, into relatively small, fist-sized pieces that, after further processing, provide a densified scrap charge in a melting furnace. A typical feed into a shredder comprises whole junk autos, discarded appliances, scrap metal recovered from demolition projects, light gauge other obsolete steel scrap and some heavier obsolete steel scrap.

The output product of the process described above is a shredded mixture comprising principally shredded ferrous scrap metal plus (a) some shredded non-ferrous scrap metal (e.g., aluminum, zinc-base alloys, copper and copper-base alloys), (b) some stainless steel and (c) up to about 25% of non-metallic material (plastic, rubber, fabric and the like). The shredded ferrous scrap metal is magnetically separated from the other materials. Other procedures, downstream of the shredder, are employed to separate the non-metallic material from the other metallics and to separate the aluminum from the other non-ferrous metals.

Shredders and their operation are described in detail in the following publication: Nijkerk, A. A. and Dalmijn, W. L., *Handbook of Recycling Techniques, Nijkerk Consultancy*, The Hague, Netherlands, 1998, pp. 88-109 (hereinafter referred to as Nijkerk).

Shredded ferrous scrap unavoidably contains pieces of tramp, non-ferrous scrap that are physically attached to or entangled with pieces of ferrous scrap by fasteners or the like, or otherwise attached, and as a result, have been carried over with the ferrous scrap pieces to which they were attached, during magnetic separation. Included among the attached and entangled non-ferrous scrap pieces are pieces of copper or copper alloys, mostly in the form of copper wire entangled with ferrous pieces or copper wire wound around the iron armatures of electric motors, particularly when the armatures are from small electric motors such as those used to operate automobile windshield wipers and window openers (see Nijkerk supra, p. 107).

Copper is undesirable as a constituent in a steel melting furnace charge for making a product known as flat rolled steel which is flawed by the presence of copper in excess of a specified maximum amount above which the steel is rendered unfit for its intended uses (e.g., deep drawing). Copper cannot be removed from a bath of melted steel by refining. If an undesirable amount of copper is present as an impurity in a steel melt, the copper content has to be diluted by the addition of relatively expensive, low copper-content scrap, such as bales of compressed, flat-rolled steel scrap salvaged as clippings or the like from industrial stamping plants and which typically contain less than 0.10% copper; these are known as factory bundles or number one bundles.

There are some steel products that are unaffected by the presence of copper in amounts that adversely affect flat rolled steel. These products include steel structural shapes (i.e., I-beams and the like), steel plate and, most particularly, steel reinforcing bars. Steel mills making these products can tolerate, in their melting furnace charge, steel scrap containing up to 0.20-0.25% copper, for example, and even higher copper percentages when the intended end product is steel reinforcing bars. Some or much of the copper and other non-ferrous materials carried over from the magnetic separation step are removed at a picking conveyor located downstream of the magnetic separator. At the picking conveyor, pieces of ferrous scrap with physically attached or entangled copper (or other non-ferrous materials) are visually located and manually removed from a moving stream of shredded ferrous scrap. This removes at least some of that copper, but other pieces of attached or entangled copper may escape removal. Copper present in shredded ferrous scrap as attached or entangled copper or copper alloy will sometimes be referred to herein as free copper or as unincorporated copper.

In addition to copper of the unincorporated kind, copper can be present metallurgically in ferrous scrap as an internal impurity, or even as an alloying addition. Copper is widely employed as an alloying addition to improve the resistance to atmospheric corrosion of both plain carbon steel and alloy steels. When so employed, the copper content of the steel is at least 0.20% and up to 1.0% or more. Copper present in shredded ferrous scrap as an internal impurity in steel or as an alloying addition in steel will sometimes be referred to herein as incorporated copper or metallurgically incorporated copper.

Given the considerations noted above, it is important for both the supplier of shredded ferrous scrap and the steel mill consumer of shredded ferrous scrap to know the copper content of that scrap, especially when the scrap is intended as part of the charge for making a flat rolled steel product.

To this end, equipment has been developed that enables one to analyze a moving stream of shredded ferrous scrap carried on a conveyor. The analyzing equipment surrounds the conveyor and provides a real-time analysis of the chemical composition of the stream as it is conveyed through the analyzing equipment. An information processor associated with the analyzing equipment calculates the average content of the copper (and other impurities and alloy constituents) over a set number of tons (e.g., an entire stockpile or a barge load).

A person monitoring the real-time analysis can detect when the shredder is producing shredded steel scrap with an undesirably high copper content and can alert the shredder operator who can make processing adjustments that increase the density of the shredded scrap by grinding it to a finer size; this reduces the amount of copper attached to pieces of shredded ferrous scrap, thereby lowering the average copper content of the ensuing batch of a set number of tons of shredded ferrous scrap.

However, practical considerations preclude lowering the copper content of a batch of several tons of shredded ferrous scrap to that of factory bundles (0.10% Cu or less). More typically, an average copper content for a relatively large batch (e.g., a barge-load of 1,300 tons) processed in the manner described above, would be, e.g., about 0.14%.

Nevertheless, because scrap suppliers employing the analyzing and information processing equipment described above, can guarantee the copper content of a load of shredded steel scrap delivered to a maker of flat-rolled steel, that steel maker will pay a premium for the scrap. The premium is substantially less than that paid for factory bundles, but it is sufficient to justify the extra capital and operating expenses the scrap supplier undergoes in order to provide the guarantee.

Shredders were first used to process junk autos and the like in the late 1950s (see *Nijkerk, supra*, pp. 88-92), and shredders have been in widespread use for the processing of ferrous scrap for several decades; but the problem of excess copper content in shredded ferrous scrap has still not been solved to the entire satisfaction of consumers of that scrap. In this regard, see the discussion entitled "Achieving Purer Ferrous Shred" in the trade journal *Scrap*, January-February 2007, pp. 107-108, which also describes, at p. 108, some attempts to deal with this problem.

The analyzing equipment described above is known as a prompt gamma neutron activation analyzer or PGNAA. This equipment, and its operation in connection with the analyzing and processing of copper-containing, shredded ferrous scrap, are described in detail, in the trade journal *Scrap*, November-December, 2006, pp. 71-78, and the description therein is incorporated herein by reference.

In Pflaum U.S. Pat. No. 5,948,137, a PGNAA is employed to analyze batches of steel scrap that are used to make up a steel melting furnace charge that conforms to a predetermined reference composition.

Additional detailed descriptions of a PGNAA and its operation are contained in Atwell et al. U.S. Pat. Nos. 5,732,115 and 4,582,992.

Pederson et al. U.S. published patent application US 2006/0115037 describes a PGNAA included in an apparatus that analyzes and separates, on a piece-by-piece basis, chemically treated timber from untreated timber, and PVC plastic from other plastic in a waste stream.

Clayton et al. U.S. Pat. No. 4,830,193 and European published application No. EP 059,033 each describe an analyzer, in some respects similar to a PGNAA, that is employed as part of an apparatus that analyzes and sorts, on a piece-by-piece basis, particles or lumps of gold ore.

There are reports of shredded scrap aluminum undergoing analysis and sorting, on a piece-by-piece basis, using laser induced breakdown spectroscopy (LIBS) to perform the analysis. *Nijkerk, supra*, at pp. 201-202, describes LIBS in detail in connection with the analysis and sorting, on a piece-by-piece basis, of shredded scrap aluminum and other non-ferrous scrap particles.

A sorter using x-ray transmission (XRT) separates shredded, low-density aluminum fragments from shredded fragments of higher density, non-ferrous metals in a mixture of shredded non-ferrous metals in which the shredded fragments have been aligned and spaced apart. The XRT sorter differentiates among the fragments on the basis of density, and the fragments are analyzed and separated on a piece-by-piece basis.

A mixture of shredded fragments of various non-ferrous metals can be sorted using x-ray fluorescence (XRF) which differentiates among the fragments on the basis of chemical composition. When one employs an XRF sorter, the fragments are aligned and spaced apart, and they are analyzed and separated on a piece-by-piece basis.

It has been reported that efforts are underway to develop an XRF sorter to remove, from shredded ferrous scrap, free and commingled copper including electric motor armatures comprising copper wire wound around an iron core (called "meatballs" in industry jargon).

A mixture of shredded scrap fragments containing two different metallic components (e.g., copper and stainless steel) can be separated into the mixture's two individual components using a piece of equipment known as a sensor sorter. The metallic fragments are aligned and spaced apart, and the fragments are analyzed and separated on a piece-by-piece basis.

When XRT, XRF and sensor sorters are used to sort a mixture of shredded non-ferrous fragments, individual fragments of one composition are sorted from other fragments in the mixture by air jets or mechanical fingers. Additional descriptions of XRT, XRF and sensor sorters are contained in the trade journal *Scrap*, November-December, 2007, pp. 113-126.

Non-ferrous sorting systems that analyze or detect individual, spaced apart fragments of shredded scrap and sort them with air jets or mechanical fingers, on a piece-by-piece basis, need to screen for size the particles of shredded scrap and maintain a particle size within maximum and minimum limits, or the sorting accuracy suffers (Id., p. 120).

There is a published paper describing the processing of a moving stream of coal wherein coal from the stream is analyzed, in a side-stream sampling loop, by a bulk material analyzer, particularly for sulfur and ash contents. (Woodward, R., et al., "Automated Coal Blending With Two Control Parameters at One of Arch Coal's West Virginia Mining Complexes", International On-Line Coal Technical Conference, St. Louis Mo., Nov. 8-10, 2004. htpp://www.thermo.com/e_Thermo/cma/PDFs/Various/File_24617.pdf).

*Nijkerk, supra*, at pp. 127-128, describes a shredding system for aluminum in which pieces of shredded aluminum containing attached pieces of iron are separated (presumably by magnetic separation) from pieces of shredded aluminum that are free of attached iron, and the pieces with attached iron are recycled to the shredder for further processing to remove the attached iron (Id., FIG. V-11-20, and p. 128).

Referring again to the moving stream of shredded ferrous scrap that undergoes analysis with a PGNAA, in one embodiment the moving stream is typically about six feet wide, eight to twelve inches deep and is typically trough-shaped in lateral cross-section (*Scrap* November-December, 2006, *supra*, pp. 72, 76). The stream flows through the analyzer typically at a rate of, e.g., 250-300 tons per hour (*Ibid.*).

In accordance with prior art procedure, and as previously noted, there is an information processor associated with the bulk material analyzer (PGNAA), and this information processor calculates the average composition for a set number of tons, e.g., the tonnage flowing through the analyzer in a given period of time (e.g., 250-300 tons in one hour). Such a tonnage will sometimes be referred to hereinafter as a "batch". As previously noted, there is a calculated average composition for the entire batch, (e.g., 0.14% copper); however, the average composition for an increment of the stream having a relatively small length (e.g., one foot or three feet or five feet, etc.) may or may not be the same as the average composition for the batch. Some of the increments may contain certain ingredients having an average composition corresponding roughly to the aforementioned average composition of the batch (e.g., a copper content of 0.14±0.02%); other increments may have an average composition substantially less than that of the batch (e.g., a copper content of 0.10% or less); and there may be still other increments that have an average composition substantially greater than that of the batch (e.g., a copper content of 0.20-0.25%, or more). Even in those streams from which virtually all pieces of attached or entangled copper or copper alloy have been visually located and manually removed at the picking conveyor, or have been otherwise detected and removed (e.g., by XRF sorting), individual increments in the stream can have average copper compositions substantially greater than that of the batch due to the presence in such increments of steel fragments containing metallurgically incorporated copper (i.e., copper present in the steel as an impurity or as an alloying agent). The presence of metallurgically incorporated copper also prevents one from reducing the average copper content of the batch generally to less than 0.12% to 0.14%, no matter the efficiency of the shredding and free copper-removing procedures employed upstream of the analyzer.

As noted above, equipment has been developed that provides a prompt, real-time analysis of a stream of shredded ferrous scrap metal, but that equipment (PGNAA) does not sort the scrap; the ability to do so would be desirable.

SUMMARY OF THE INVENTION

The present invention is directed to a method for bulk sorting a stream of shredded scrap metal. The method employs apparatus that includes a bulk material analyzer, an information processor associated with the analyzer, a conveyor belt, or the like, for moving a stream of shredded scrap metal through the analyzer downstream toward an accumulation location such as a barge or stockpile, and a bulk sorting system located between the analyzer and the accumulation location.

In accordance with the present invention, the stream is divided into bulk increments each comprising a multiplicity of individual, unadhered fragments of shredded scrap metal. The stream of shredded scrap metal is a continuous stream wherein the increments are disposed in abutting end-to-end relation. The step of dividing the stream into increments is performed without reference to the chemical composition of the stream. The stream undergoes analysis by the bulk material analyzer; as this occurs, the processor (a) calculates the average chemical composition of each bulk increment and (b) identifies each increment having a composition conforming to a predetermined reference composition that has been input into the processor. Each bulk increment having a conforming composition is diverted from the stream by the bulk sorting system. A plurality of these conforming increments are diverted from the stream while, at the same time, non-conforming increments intermixed with the conforming increments upstream of the sorting system are directed from the sorting system downstream toward the accumulation location.

The method may be employed to further reduce the copper content of shredded ferrous scrap from which attached and commingled copper (including "meatballs") has been previously removed by manual pickers or by some other procedure for removing such copper. In such a case, the copper content of the shredded ferrous scrap (e.g., 0.14% Cu) is due at least primarily to metallurgically incorporated copper, i.e., copper that is present in the steel internally, either as an impurity or as an intentionally added alloying ingredient. Those increments having a copper content greater than a predetermined amount (e.g., greater than 0.20% Cu) are diverted from the stream. The undiverted increments are accumulated downstream of the bulk sorter; the accumulation of undiverted increments has an average copper content less than that obtained merely by removing attached and commingled copper and is thus more useful as a feedstock for producing flat rolled steel.

The diverted increments are accumulated in a separate stockpile having an average copper content greater than 0.20%, due primarily (if not entirely) to metallurgically incorporated copper. This material may be useful as a feedstock for producing a steel resistant to atmospheric corrosion, a steel normally containing 0.20-1.00% Cu as an intentionally added alloying ingredient.

In another embodiment, the method processes a stream of shredded ferrous scrap that still contains substantial quantities of attached and commingled copper. In this embodiment, the method diverts from the stream all increments having an undesirably high copper content (e.g., 0.20% Cu and above), whether that copper content is due to attached and commingled copper or metallurgically incorporated copper or both. Those diverted increments having discernible amounts of attached and commingled copper may be separated from the other diverted increments and recycled back to the shredder.

The processor may be provided with more than one predetermined reference composition, as inputs. The analyzer and the associated information processor together comprise a bulk material analyzing system. Each increment conforming to a respective one of the reference compositions is diverted along a respective diversion path by the bulk sorting system in response to a sorting determination performed by the bulk material analyzing system on each increment, a determination made on the stream at regular intervals, multiple times per minute.

Thus, the method may be employed to divert from the stream not only (a) increments having an undesirably high copper content (e.g., >0.20% Cu) but also (b) increments having a desirably low copper content (e.g., 0.10% copper); and the latter increments are accumulated in a stockpile to be sold at a premium as a low-impurity content material.

In another embodiment, the method may be employed to divert, from a stream of shredded ferrous scrap, increments having one or more desirable alloying ingredients employed in alloy steels (e.g., chromium, nickel, molybdenum); and these increments are accumulated in a stockpile to be sold as a separate material for use as a feedstock for producing alloy steels. A related embodiment produces a stockpile having a composition that contains not only one or more of Cr, Ni and Mo but also contains copper, thereby enabling the stockpile to be used as a feedstock for producing alloy steels that are resistant to atmospheric corrosion. All of these feedstocks are materials of increased value.

Similarly, the method may be employed to divert, from a stream of shredded ferrous scrap, increments containing manganese or silicon in respective percentages greater than those normally contained in plain carbon steel (1.65% max. Mn and 0.60% max Si, in plain carbon steel). The diverted increments may be accumulated and sold as a feedstock for producing an alloy steel containing, as alloying ingredients, manganese or silicon in amounts greater than those normally contained in plain carbon steel.

The method may be employed on shredded ferrous scrap or on shredded non-ferrous scrap. In the case of non-ferrous scrap, the method may be employed to separate, from a shredded mixture comprising copper, copper-base alloys and zinc-base alloys, a material with an average zinc content lower than that of the shredded mixture (e.g., less than 40% Zn in the separated material), and this material may be used as a feedstock for producing brass casting alloys. The particle size of the shredded scrap fragments is not a factor when one employs the method of the present invention to separate out a feedstock for producing brass casting alloys.

Other features and advantages are inherent in the method claimed and disclosed or will become apparent to those skilled in the art from the following detailed description in conjunction with the accompanying diagrammatic drawings.

DETAILED DESCRIPTION

Figure 1:
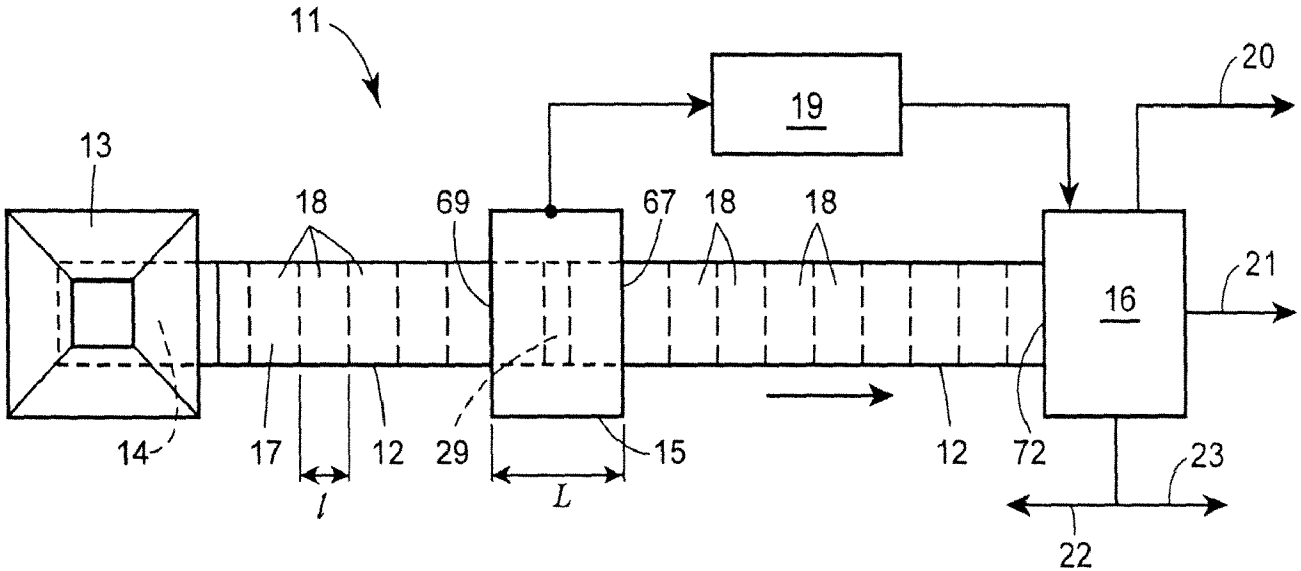
FIG. 1 is a flow diagram illustrating an embodiment of a method in accordance with the present invention.

Referring initially to FIG. 1, indicated generally at 11 is an apparatus for performing a method in accordance with an embodiment of the present invention. Apparatus 11 comprises a conveyor belt 12 having an upstream end adjacent which is a hopper 13 that dispenses shredded scrap metal, preferably at a uniform rate, onto a shaker table 14 that cooperates with the hopper to distribute substantially uniformly the shredded scrap metal onto conveyor belt 12 adjacent its upstream end. Downstream of the belt's upstream end is a bulk material analyzer 15 (typically a PGNAA) that surrounds conveyor belt 12.

Analyzer 15 includes an activation region 29 in which a stream 17 of shredded scrap metal is chemically analyzed as the stream moves through the activation region. An example of the activation region in a PGNAA, its location in the analyzer and the manner in which it operates are described in detail in Atwell et al. U.S. Pat. No. 5,732,115, and the disclosure therein is incorporated herein by reference.

Conveyor belt 12 moves a stream 17 of shredded scrap metal downstream through analyzer 15 and its activation region 29 toward a bulk sorting system 16 located downstream of analyzer 15.

Associated with analyzer 15 is an information processor 19 into which has been input one or more predetermined reference compositions. For example, when the stream is shredded ferrous scrap, one such reference composition may comprise a maximum copper content of 0.10%; another reference composition may comprise a minimum copper content of 0.20%. Processor 19 can be any general purpose processor, or it can be a dedicated processor.

Stream 17 is a continuous stream, and it is divided into a series of bulk increments 18,18 disposed in abutting, end-to-end relation. The step of dividing the stream into increments is performed without reference to the chemical composition of the stream. The manner in which stream 17 is divided into increments will be subsequently described. Each increment comprises a multiplicity of individual, unadhered fragments of shredded scrap metal. The fragments of an increment are disposed in irregularly arranged, multiple layers with the fragments positioned one atop another. The cross-section of an increment constitutes an uninterrupted continuum of fragments along the length, width and depth of the increment. In the method of the present invention, the fragments of shredded scrap are neither aligned nor spaced apart. As used herein, the terms "aligned" and "spaced apart" refer to the manner in which the shredded scrap fragments are arrayed during the sorting operations performed thereon by the sensor sorters and by the sorters employing XRT and XRF analyzers, all of which were referred to earlier herein.

Figure 2:
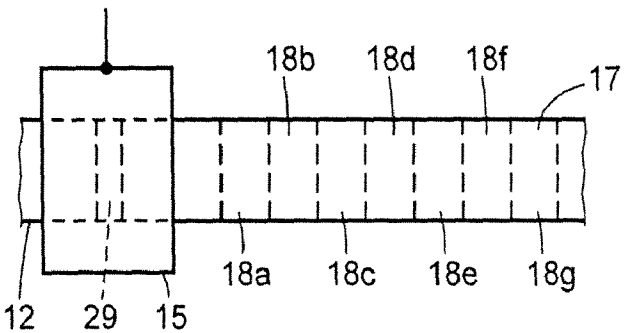
FIG. 2 is a fragment of the flow diagram of FIG. 1.

There can be a variation in chemical composition among the increments 18,18 in stream 17, and this is illustrated in FIG. 2. For example, assume that the entirety of stream 17 over a period of time is a set number of tons and that the average copper content for stream 17 is 0.14%. Some increments in stream 17 (e.g., increments 18*a*, 18*c* and 18*e*) may have a copper content that is approximately the average copper content of stream 17 (e.g., 0.14%±0.02%); other increments (e.g., 18*b* and 18*d*) may have a copper content substantially less than 0.14% (e.g., 0.10% or less); and still other increments (e.g., 18*f* and 18*g*) may have a relatively large copper content (e.g., 0.20-0.25%, or more).

As stream 17 moves through activation region 29 of analyzer 15, the stream and its increments 18,18 undergo a real-time chemical analysis which is communicated by analyzer 15 to processor 19 which: (a) calculates the average (bulk) chemical composition of each increment; (b) compares that chemical composition to the reference composition that has been input into the processor, and (c) identifies each increment having a composition that conforms to the reference composition. Normally, movement of an increment 18 through analyzer 15 is continuous, without interruption.

Processor 19 keeps track of each increment 18 as the increments are conveyed downstream from analyzer 15. Increments that do not have a composition conforming to the reference composition are intermixed, upstream of bulk sorting system 16, with increments having a conforming composition. When an increment 18 having a conforming composition arrives at bulk sorting system 16, processor 19 (which also functions as a controller) instructs bulk sorting system 16 to divert the conforming increment 18 from stream 17, as indicated at arrow 20 in FIG. 1. Each conforming increment is diverted by bulk sorting system 16 from the intermixture of conforming and non-conforming increments. The non-conforming increments from the intermixture are directed downstream from bulk sorting system 16 toward an accumulation location, as indicated by arrow 21. The accumulation location can be a barge or a stockpile, for example. A plurality of conforming increments from the intermixture are diverted from stream 17 while, at the same time, non-conforming increments from the intermixture are directed downstream from sorting system 16 toward the accumulation location (arrow 21).

The diverted conforming increments indicated at arrow 20 are stockpiled for eventual sale as a material of higher value (e.g., as shredded ferrous scrap having a copper content no greater than 0.10%).

The foregoing discussion describes a process that diverts, from stream 17, increments having a desirably low level of a specified element. Apparatus 11 may be employed to divert, from the stream, increments having a relatively high level of that (or some other) element; for example, in the case of copper-containing shredded ferrous scrap, a relatively high level of copper could be in the range 0.20-0.25%, or more. In such a situation, an additional reference composition, specifying the aforementioned high copper level, will have been input into processor 19; and when processor 19 identifies an increment 18 conforming to the additional reference composition, processor 19 instructs bulk sorting system 16 to divert, from stream 17, the increment having the high copper content, as indicated by the arrows 22-23 in FIG. 1.

The high copper content in an increment 18 may be due to free copper that has escaped visual identification and manual removal at the picking conveyor, or in a case where the shredding and/or manual picking operations (or other free copper-removing procedures) are highly efficient, a high copper content in the increment will be due primarily, if not entirely, to metallurgically incorporated copper. In other cases, the high copper content can be due to a combination of substantial amounts of both free copper and metallurgically incorporated copper.

A diverted increment 18 having a high copper content due to large amounts of free copper may be recycled back to the shredder for additional processing to reduce the amount of attached non-ferrous material (arrow 22), or the diverted increment may be stockpiled for eventual sale to a steelmaker whose products can tolerate a high level of free copper (arrow 23).

Diverted increments containing a high copper content due to substantial amounts of free copper can be identified visually; they may be recycled back to the shredder relatively without delay for feeding into the shredder as part of a mix including other ferrous materials. Preferably however, these diverted increments are temporarily accumulated in a stockpile until the stockpile is large enough to warrant a separate run through the shredder; and in such a run, the feed to the shredder is composed entirely of material from this stockpile. In such a case, the operating parameters of the shredder can be controlled to reflect the fact that the feed is composed entirely of previously shredded ferrous scrap containing large amounts of free copper, and the shredder is operated to grind the recycled scrap to a finer size.

In one embodiment of the present invention, the recycled shredded scrap with the high free copper content can be re-shredded in a shredder having grates with smaller openings than the grates employed in the initial shredding of the material. This increases the extent to which the recycled material is shredded to a smaller size, thus freeing up more of the attached free copper.

Recycling the diverted increments with high free copper content has at least two advantages: (1) it lowers the average copper content of the shredded ferrous scrap returned to the stream after re-shredding; and (2) it increases the amount of non-ferrous scrap that can be separated from the shredded ferrous scrap and sold separately as a material of higher value.

In conventional practice, the analyses from a bulk material analyzer were monitored, and when the monitor noted an undesirably high copper content in the shredded scrap (usually due to the presence of excessive free copper), this was reported to the shredder operator who made adjustments at the shredder to grind the scrap to a higher density. This may have reduced the copper content of the ferrous scrap that was shredded after the adjustments were made, but it did nothing for the high free copper-content scrap that had already been shredded. This flaw in conventional practice is eliminated when one employs the above-described embodiments of the present invention in which the increments with the undesirably high free copper content are (a) diverted from the rest of the shredded scrap and (b) recycled back through the shredder where the recycled increments are ground to a finer size.

In those cases where the shredding and/or manual picking operations (or other free copper-removing operations) are highly efficient, there is little or no free copper in those increments having a high copper content; in such cases, the high copper content (upwards of 0.20%) is due to metallurgically incorporated copper, and these increments may be diverted (arrow 23) to a separate stockpile and accumulated there to provide a feedstock for producing a steel that is resistant to atmospheric corrosion, i.e., a steel that contains a copper content of at least 0.20% and up to 1% or more.

When one diverts, along the path indicated by arrow 23, those increments having a high copper content due to metallurgically incorporated copper, this has the additional advantage of lowering the average copper content in the accumulation of undiverted increments (arrow 21) from which free copper has also been removed. In such a case, the average copper content of the undiverted increments is lowered to a value below that which can be obtained merely with a free copper-removing operation, no matter how efficient are the free copper-removing operation and the shredding operation that precedes it.

There is an embodiment of the present invention which, at least in theory, should enable one to dispense with most of the manual pickers normally employed to remove free copper. In this embodiment, all increments analyzed as having an undesirably high copper content (e.g., greater than 0.20%) are diverted at sorter 16 (FIG. 1) onto a slightly inclined shaker table (not shown) having an area (length by width) substantially greater than the corresponding area of each of the diverted increments, thereby enabling a diverted increment to spread out so as better to reveal to an observer the presence in the increment of entrapped or commingled free copper; or one may employ some other device to rearrange physically a diverted increment so as better to reveal the presence of free copper. As to each such increment, a determination is made regarding the extent to which free copper is present, and at least some (preferably most and more preferably all) increments having discernible free copper are recycled back upstream for additional shredding (arrow 22 in FIG. 1). Each increment without discernible free copper, and thus an increment having its undesirably high copper content due primarily or entirely to metallurgically incorporated copper, is not recycled for additional shredding, but instead is directed to a stockpile for such increments (arrow 23 in FIG. 1), a stockpile that is separate and discrete from the accumulation stockpile to which the undiverted increments are directed (arrow 21). A determination as to the presence of discernible free copper and its extent can be made visually by an observer (a subjective determination) who may also be monitoring analyzer 15, or the observation function may be performed by an appropriate optical system. Except for a manual picker retained to remove tramp non-metallic material, no other manual pickers need be employed.

Some of the embodiments described above divert both (a) increments having a desirably low copper content (arrow 20) and (b) increments having a high copper content (arrows 22, 23). Another embodiment of the present invention diverts only increments having the high copper content. In all embodiments, an advantage obtained by diverting, from stream 17, increments having a high copper content is that it lowers the average copper content in the batch of undiverted increments at arrow 21, thereby increasing the value of that batch, the average composition of which has been calculated by processor 19. Typically, the undiverted increments at 21 are weighed on their way to a stockpile, e.g., on a belt scale (see *Nijkerk, supra*, p. 107). Also weighed on their way to a stockpile are (a) the low copper content, diverted increments at 20 and (b) those high copper content, diverted increments that are not recycled to the shredder (arrow 23). It is unnecessary to weigh stream 17 before increments 18,18 are analyzed.

In summary, with respect to the processing of a stream of shredded ferrous scrap containing copper as an impurity, increments are diverted from that stream in accordance with their conformity to one of two predetermined reference compositions. One such reference composition specifies a maximum copper content substantially below the average (mean) copper content of the increments that are undiverted from the stream, e.g., a maximum copper content no greater than 0.10%. Another such reference composition specifies a minimum copper content substantially greater than the average (mean) copper content of the increments that are not diverted from the stream, e.g., a minimum copper content in the range 0.20-0.30%. Expressed another way, one reference composition specifies a maximum copper content that is below the copper content in the portion of stream 17 that is upstream of sorting system 16, and the other reference composition specifies a minimum copper content that is above the copper content in that portion of stream 17 that is upstream of sorting system 16.

Further with respect to a stream 17 of shredded scrap that has been divided into increments 18,18 each of which has been analyzed for its copper content, one may plot (a) the copper content of the increments along the x-coordinate of a graph and (b) the number of increments having a given copper content along the y-coordinate. The resulting distribution curve would, it is believed, be generally bell-shaped; in addition, the curve may be disproportionately skewed to the right, i.e., in the direction of the higher copper percentages. It is believed that the aforementioned skew would probably be present when the curve depicts the copper distribution for a stream of shredded ferrous scrap comprising both free copper and metallurgically incorporated copper; also, the skew may be present when the curve is for a stream that has been picked clean, or nearly clean, of free copper. In the latter case, the mean copper content of the stream is typically in the range 0.12-0.16%, e.g., 0.14%.

As noted above, the mean copper content of the stream can be reduced by sorting out or diverting those increments having a mean copper content greater than the mean copper content of the stream as a whole before sorting. For example, with respect to a stream that has been picked clean, or nearly clean, of free copper, and that has a mean copper content of 0.14% before sorting, one would divert, from the stream, increments having a mean copper content greater than 0.14%, e.g., increments having a minimum copper content in the range 0.15-0.20%. After sorting, the stream containing the undiverted increments would have a mean copper content less than 0.14%. The diverted increments are accumulated in a stockpile that would have a mean copper content greater than 0.15%, e.g., 0.20% or more. In an idealized case, the mean copper content in the stream of undiverted increments, after sorting, is no greater than 0.10%. In actual practice, the mean copper content of that stream may be in the range 0.11-0.13%. The whole gamut of possible mean copper contents for that stream is projected to be within a range that includes 0.09% to 0.13%

Shredded ferrous scrap is used in the manufacture of new steel and for that purpose, the scrap is shipped to both domestic and foreign steel mills. Shipment may be by barge on waterways, either directly to domestic steel mills or to ports for export. Shipment may also be by land via rail gondola car. As used herein, the term "unit shipment via land transportation" refers to a shipment via rail gondola car.

Rail gondola cars vary in car length and in the height of the car sides; tonnage capacities of rail gondola cars vary with variations in car size. There are rail gondola cars in common use that have car lengths in the range 48 feet to 65 feet with a 5/2-foot car side height, and these cars have tonnage capacities in the range 70 to 109 tons. The volume capacity of a car also varies with car length and car side height. Tabulated below are car volume capacities for a 52-foot car length with a range of car side heights between 4 feet and 8 feet.

| Side Height in Feet | Volume Capacity in Feet$^3$ |
|---|---|
| 4' | 1,995 |
| 4'6" | 2,244 |
| 4'8" | 2,335 |
| 5' | 2,494 |
| 5'6" | 2,743 |
| 8' | 4,000 |

An example of a rail gondola car in high demand for the shipment of ferrous scrap is one having a length of 52 feet, a car side height of 5½ feet, a weight capacity greater than 70 tons, and a volume capacity of 2,743 feet$^3$.

The relevance of (i) a unit shipment via land transportation to (ii) the mean copper content of a stockpiled quantity of diverted increments, will be discussed later.

In addition to sorting out, from shredded ferrous scrap, increments containing low levels or high levels of copper, the present invention may also be utilized to sort out increments containing certain desirable alloying ingredients used in alloy steels. Principal alloying ingredients in many, if not most, alloy steels are chromium, nickel and molybdenum, used either alone or in combination. (See *Metals Handbook, Desk Edition,* 1995, pp. 4-8 to 4-11, 4-15 to 4-19, 4-26 and 4-51 to 4-53, American Society for Metals, Metals Park, Ohio; the disclosure therein is incorporated herein by reference.) There are other alloy steels that do not rely on Cr, Ni or Mo as alloying ingredients, and these steels may contain, as an alloying ingredient, manganese or silicon in an amount greater than the amount of that element contained in plain carbon steel (up to 1.65% Mn and up to 0.60% Si in plain carbon steel). (Ibid) Obsolete scrap items, or parts thereof, made from these alloy steels will find their way into the stream of shredded ferrous scrap. An embodiment of the present invention may be employed to divert, from the stream of shredded ferrous scrap, increments containing an amount of one or more of the alloying ingredients chromium, nickel and molybdenum or increments containing manganese or silicon in an amount greater than the amount of that element contained in plain carbon steel. With respect to the increments containing one or more of Cr, Ni and Mo, at least nickel, and preferably nickel and chromium, and most preferably all three of these alloying ingredients, each constitutes at least 0.20% of the diverted increment's composition. This embodiment of the present invention can be performed by providing information processor 19 with a predetermined reference composition that enables the identification and diversion of increments of the type described in the preceding two sentences. These diverted increments are then accumulated in a stockpile that can be used as a feedstock for producing an alloy steel comprising chromium, nickel and molybdenum, or comprising manganese or silicon in increased amounts, as the case may be.

Many such alloy steels also include a copper content of at least 0.20% for imparting, to such steels, a resistance to atmospheric corrosion. (*Metals Handbook, supra*, pp. 4-15 to 4-17, 4-29 and 4-51 to 4-53) Some of the increments that contain chromium, nickel or molybdenum, and that are diverted to the alloy steel stockpile, may also contain copper. The information processor preferably maintains a running tally on the mean copper content of the alloy steel stockpile, and in order to assure that the alloy steel stockpile has a mean copper content that is useful for producing an alloy steel resistant to atmospheric corrosion (preferably of at least 0.20% copper), the processor can instruct bulk sorting system 16 (FIG. 1) to divert to that stockpile, from stream 17, copper-containing increments that do not contain chromium, nickel or molybdenum in the desired amounts (or at all). The copper-containing increments diverted to the alloy steel stockpile preferably contain at least 0.20% copper. The resulting stockpile has a composition that includes Cr, Ni, Mo and Cu and may be used as a feedstock for producing an alloy steel that is resistant to atmospheric corrosion.

An alloy steel stockpile having a composition including chromium, nickel and molybdenum as alloying ingredients, and produced in accordance with a method of the present invention, is a material of increased value compared to stockpiles without the aforementioned alloying ingredients. An alloy steel stockpile having a composition that also comprises copper has additional increased value. In summary, an alloy steel stockpile, produced by a method in accordance with the present invention, comprises one or more of chromium, nickel and molybdenum, preferably at least 0.20% of each, and more preferably also comprises copper (most preferably at least 0.20% copper).

The preceding description relates primarily to the processing of shredded ferrous scrap that has been magnetically separated from a shredded mixture also including (i) shredded non-ferrous scrap and (ii) non-metallic materials. There are established procedures for separating the shredded non-ferrous scrap from the non-metallic materials and for separating the shredded aluminum scrap from the other shredded non-ferrous scrap (principally copper and copper-base alloys, and zinc-base alloys). The mixture of shredded, non-ferrous scrap, from which the shredded aluminum scrap was separated, can, in theory, be sorted on a piece-by-piece basis using sophisticated sorting equipment. In practice, however, it has proven to be more economical to ship this mixed scrap to countries having low cost labor that hand sorts the scrap.

The present invention may be employed to sort out, from a stream of shredded non-ferrous scrap, increments that can be used in a feedstock employed to produce one or more brass casting alloys; these are alloys which contain copper, zinc, tin and lead in various proportions.

As previously noted, the stream of non-ferrous shredded scrap under consideration here contains copper, and copper-base alloys, and zinc principally in the form of zinc-base alloys, and the stream may contain lead. The copper-base alloys contain zinc and may also contain tin and lead.

The zinc-base alloys in the shredded scrap stream are primarily zinc die casting alloys which, in addition to zinc, contain some aluminum (3.5-4.3%), a small quantity of magnesium (up to 0.08%) and some copper (0.10 and 0.25% max for some Zn alloys; and 0.75-1.25% for other Zn alloys). The presence of copper in a feedstock for producing brass casting alloys is, of course, desirable. The small percentages of aluminum and magnesium carried over to a feedstock as part of a zinc die casting alloy will be oxidized out during smelting and refining of the brass casting alloys, as discussed more fully below.

The mixture of shredded non-ferrous scrap typically contains proportionately substantially more zinc, in the form of zinc-base alloys, than copper (alloyed and unalloyed), whereas the proportions of copper to zinc in various brass casting alloys is just the reverse, as illustrated in the following tabulation.

| | Nominal Composition, Wt. % | | | | Zinc Tolerance, |
|---|---|---|---|---|---|
| Casting Alloy | Cu | Sn | Pb | Zn | ±wt. % |
| Yellow Brasses | 58-72 | 0-1 | 0-3 | 24-40 | 3-5 |
| Semi-Red Brasses | 76-81 | 0-5 | 2.5-7 | 9-15 | 1-2 |
| Red Brasses | 83-93 | 0-5 | 0-6 | 4-10 | 1-2 |

In each category of brasses tabulated above, there are several compositions. For example, one of the most commonly used red brasses is designated C 83600 and has the following nominal composition, in wt. %: 85 Cu, 5 Sn, 5 Pb, 5 Zn. For this composition, the permissible range for zinc is 4-6%, or a zinc tolerance of ±1%. (The higher the nominal zinc content, the greater the tolerance.) Additional details on casting brass compositions is contained in *Metals Handbook, supra*, at pp. 7-10 and 7-11.

A method for producing a feedstock that can be used to make one or more brass casting alloys will now be described.

In accordance with the present invention, and referring to FIG. 1, a stream of shredded non-ferrous scrap is divided into increments, such as 18,18 in FIG. 1; the bulk chemical composition of each increment 18 is determined at analyzer 15, and those increments conforming to a predetermined reference composition specifying a zinc content no greater than 40% are diverted at sorter 16 (e.g., along diversion path 20) to a stockpile used as a feedstock for producing brass casting alloys. The undiverted increments (arrow 21 in FIG. 1) are accumulated in a downstream stockpile that will have an average zinc content greater than that of the non-ferrous mixture upstream of sorter 16 as well as an average copper content less than that of the upstream mixture (stream 17). The stockpile of undiverted increments (arrow 21), with its increased zinc percentage, may be shipped overseas for hand sorting or may be otherwise processed.

All diverted increments are directed to a conveyor belt and weighed on a belt scale before being accumulated in a stockpile. Because processor 19 knows the weight and bulk chemical composition of each increment in the stockpile, the processor can keep a running account of the weight and bulk chemical composition of the stockpile.

The stockpile of diverted increments (arrow 20) will have a higher value than the mixture of unsorted increments upstream of sorter 16 (i.e., stream 17), while the stockpile of undiverted increments (arrow 21) will have a lower value than the unsorted mixture, and this will be reflected in the payment received when the stockpile of undiverted increments is shipped away for hand sorting; however, the lower value of the latter stockpile (arrow 21) should be more than offset by the higher value of the stockpile of diverted increments (arrow 20).

Brass casting alloys are produced primarily by secondary smelters and refiners who use feedstocks composed almost entirely of scrap metal some of which unavoidably will contain undesirable elements such as tramp iron. Iron impurities are normally removed from a heat, during refining, by an oxidation procedure (a) which will also remove other, easily oxidizable elements such as aluminum and magnesium and (b) which can also be used to remove excess zinc. Thus, to the extent that feedstocks produced by the present invention may contain small quantities of aluminum and magnesium (e.g., from zinc die casting alloys) these elements will be removed during a normal refining operation.

Magnesium is not necessarily an undesirable ingredient in a feedstock for making a brass casting alloy. Magnesium has been conventionally added to a molten bath of brass casting alloy to remove sulfur which is an undesirable impurity in that alloy. The magnesium combines with the sulfur in the bath to form a chemical compound which is incorporated into a slag atop the molten bath, and the sulfur-containing compound is removed with the slag.

The feedstocks produced by the present invention may contain smaller percentages of tin and lead than are required in some brass casting alloys, but these deficiencies can be made up by adding to the heat, during the refining operation, other scrap metals containing higher percentages of tin and lead, a conventional expedient normally employed by secondary smelters and refiners of brass casting alloys.

Referring again to the stockpile of diverted increments (arrow 20), this stockpile has an average zinc content no greater than 40%, and it can be used without further sorting as a feedstock for yellow casting brass (≦40% Zn). Alternatively, the stockpile can be subjected to further bulk sorting into smaller stockpiles composed respectively of (a) increments containing no more than 10% zinc which can be used as a feedstock for producing a red casting brass, (b) increments containing 10-20% zinc which can be used as a feedstock for producing a semi-red casting brass, and (c) increments containing 20-40% zinc which can be used to produce a yellow casting brass. Even if the zinc content of a given feedstock (a)-(c) exceeds the nominal zinc content of the specific casting brass composition for which the feedstock is being used, this deviation can be readily adjusted during the refining operation, an adjustment routinely employed by secondary smelters and refiners of brass casting alloys.

Bulk sorting into these three feedstocks, as proposed in the preceding paragraph, can be accomplished by employing three separate reference compositions, one for each feedstock (a)-(c). In such a case, and referring to FIG. 1, an increment conforming to reference composition (a) is diverted along path 23; an increment conforming to reference composition (b) is diverted along path 22; and an increment conforming to reference composition (c) is diverted along path 20. Undiverted increments continue along path 21.

The embodiment described in the preceding paragraph is employed in lieu of the embodiment which merely diverts into one diversion stockpile those increments containing all zinc contents up to 40%. Another embodiment, described hereafter in this paragraph, employs the single stockpile of previously diverted increments, each containing up to 40% zinc, as the starting point for another sorting procedure using three reference compositions and three diversion stockpiles, as in the embodiment described in the preceding paragraph; this embodiment can be performed by a secondary smelter or by one who prepares feedstocks for a secondary smelter. One who performs this embodiment starts with a stream of shredded scrap composed of previously-sorted increments each containing up to 40% zinc. The stream is divided into increments 18,18, as in FIG. 1; the composition of each increment is determined at analyzer 15; and each increment conforming to a respective one of three predetermined reference compositions is diverted at sorter 16 along a respective diversion path 20, 22, 23 to a respective stockpile.

With reference to the tabulation, a procedure that is the equivalent of (a) looking for and diverting increments having a relatively low zinc content (up to 40% Zn) is (b) looking for and diverting increments having a relatively high copper content (e.g., 58-92% Cu) and/or (c) looking for and diverting increments containing about (i) 58-72% Cu (for yellow brass), (ii) 76-81% Cu (for semi-red brass) and (iii) 83-93% Cu (for red brass), with the increments for each of these three brasses being diverted along a respective one of these diversion paths.

One who employs those embodiments of the present invention that sort shredded non-ferrous scrap into feedstocks for brass casting alloys can use the same analyzing/sorting equipment 15,16 as is used to sort copper-containing shredded ferrous scrap. This would be the case where the one who employs these embodiments also operates the shredder where the shredded non-ferrous scrap originated.

Alternatively, one can use analyzing/sorting equipment dedicated to the sorting of non-ferrous scrap, which, for a number of reasons, can be smaller and less sophisticated than the equipment used to process copper-containing, shredded ferrous scrap. The dedicated equipment would be used principally by secondary smelters or those who prepare feedstocks for secondary smelters, and who have no need for the larger, more sophisticated equipment used in the processing of copper-containing, shredded ferrous scrap. More particularly, the volume of shredded non-ferrous scrap to be processed in accordance with the present invention is a small fraction of the volume of shredded ferrous scrap processed by the present invention; accordingly, the equipment can be smaller in size. As will be discussed more fully below, copper-containing, shredded ferrous scrap needs to be sorted to a finer tolerance than feedstock for brass casting alloys; hence, the analyzing equipment for the latter material need not be as sophisticated or fine-tuned as the analyzing equipment for the former material. As a result of the factors discussed in the preceding part of this paragraph, equipment dedicated to the sorting of shredded non-ferrous scrap will be smaller, simpler and less expensive than equipment employed to sort copper-containing, shredded ferrous scrap. [00100] When one analyzes for the content of an element that is present as a small fraction of one percent, as in the case of the copper content of shredded ferrous scrap, one must take into consideration a factor known as the error on the mean. More particularly, a bulk material analyzer, such as a PGNAA, determines the average or mean chemical composition of a batch of material. The accuracy of that determination is reflected by the error on the mean, expressed here as plus-minus (±) a fraction of a percent.

The error on the mean is inversely proportional to the square root of the number of samples (here, the number of increments) analyzed in determining the mean chemical composition of the batch. Thus, the more samples (i.e., increments) one analyzes, the smaller the error on the mean and the more accurate the determination.

The error on the mean also is directly proportional to the error on the analyzer, which can be expressed as the error on a single sample or increment. The error on the analyzer reflects the precision or accuracy of the analyzer and is, in the case of a PGNAA, affected by the quantity of gamma rays detected by the analyzer under a given set of conditions or process parameters. The error on a given analyzer (i.e., its accuracy) is also a reflection of the internal characteristics of that analyzer, including its neutron-producing and gamma ray-detecting structures. (A PGNAA employs a radioactive isotope that produces neutrons which excite the material undergoing analysis in the analyzer's activation region in turn causing that material to emit gamma rays that are detected by gamma ray detectors located above the activation region.)

Generally, the larger the quantity of gamma rays detected for a given sample, the smaller the error on the mean. For example, it is believed that increasing (a) the quantity of gamma rays detected, by a factor of four, decreases (b) the error on the mean by a factor equal to the square root of the factor reflecting the increase in the quantity of gamma rays detected: in this example, the error on the mean is decreased by $\sqrt{4}=2$.

In addition to the internal characteristics of the PGNAA, the quantity of gamma rays detected for an increment can be affected by other parameters such as the speed of the conveyor belt and the length of an increment; both of these parameters affect the length of time the moving increment spends in the activation region of the PGNAA and hence the quantity of gamma rays emitted by that increment as the material in that increment undergoes excitation.

In the following examples (all of which are projections), unless it is otherwise stated, one may assume the following process parameters: the stream of shredded ferrous scrap is three feet wide and about twelve inches thick, and it has a density of 70 pounds/foot$^3$; the stream is traveling at a speed of one foot per second; the PGNAA has an activation region two feet long in the direction of stream travel; the increment length in the direction of stream travel is three feet; and the error on the analyzer for the relevant process parameters described above is 0.45%.

EXAMPLE A

The reference composition programmed into the information processor specifies a minimum copper content of 0.20% for the increments that are to be diverted from the stream. An acceptable error on the mean for a copper content of 0.20% and above is 0.03%. More particularly, as noted above, steels that are resistant to atmospheric corrosion can have a copper content in the range 0.20%-1.0%. The tolerance for a copper content in this range can be ±0.03%. Accordingly, for a stockpile of diverted increments conforming to a reference composition specifying a copper content of 0.20% and above, an acceptable error on the mean can be 0.03%.

Assuming an error on the analyzer of 0.45%, the number of increments required to obtain an error on the mean of 0.03%= $(0.45/0.03)^2=(15)^2=225$. Each increment has a volume of about 9 feet$^3$ and weighs about 630 pounds, so that 225 increments weigh 141,750 pounds, or about 71 tons, which is within the weight capacity of most rail gondola cars (i.e., a unit shipment via land transportation). The volume of 225 increments of 9 feet$^3$ each is 2,025 feet$^3$, also well within the capacity of most rail gondola cars.

If the density of the shredded ferrous scrap had been 60 pounds/foot$^3$, instead of 70 pounds/foot$^3$, the 225 increments would have weighed 119,500 pounds or about 60 tons. If the density had been 80 pounds/foot$^3$, the 225 increments would have weighed 162,000 pounds, or 81 tons. In both instances, the batch of 225 increments could have been accommodated in most, if not all, rail gondola cars, thereby corresponding, in each such instance, to a unit shipment via land transportation. If the density of the shredded ferrous scrap had been 90 pounds/foot$^3$, the 225 increments would have weighed 182,250 pounds or about 91 tons, a batch weight which is within the capacity of the larger rail gondola cars commonly used to transport steel scrap.

EXAMPLE B

The error on the analyzer is 0.9. The number of increments required to produce an error on the mean of 0.03 is $(0.9/0.03)^2=(30)^2$ or 900 increments, which, at an increment weight of 630 pounds is 567,000 pounds for 900 increments, or about 284 tons which exceeds the weight capacity of the largest rail gondola cars employed to transport ferrous scrap. Reducing the speed of the conveyor belt from one foot per second to one foot every four seconds increases the quantity of gamma rays detected for a given increment by a factor of four and reduces the effective error on the analyzer for a given increment by a factor of two, or from 0.9 to 0.45 (the error on the analyzer in Example A). Accordingly, the number of increments required to produce an error on the mean of 0.03 is $(0.45/0.03)^2=(15)^2=225$ increments which, at an increment weight of 630 pounds, is about 71 tons, as in Example A. At a conveyor belt speed of one foot every four seconds and an increment weight of 630 pounds, one can analyze 300 increments, or 94.5 tons, in one hour and 756 tons in eight hours. An increment weight of 630 pounds is for an increment of shredded ferrous scrap having a density of 70 pounds/ft.$^3$. At a density of 80 pounds/ft.$^3$, an increment weighs 720 pounds; at a rate of 300 increments per hour, one can analyze 108 tons in one hour and 864 tons in eight hours. At a density of 90 pounds/ft.$^3$, an increment weighs 810 pounds; at a rate of 300 increments per hour, one can analyze 121.5 tons per hour and 972 tons in eight hours.

EXAMPLE C

The stream of shredded scrap is six feet wide and eight inches thick; the volume of an increment 3 feet long is 12 feet$^3$, and the increment's weight is 840 pounds. The other process parameters, relevant to determining the error on the mean, are the same as in Example A. Accordingly, the number of increments required to obtain the desired error on the mean is the same as in Example A, namely, 225 increments. However, in this example, 225 increments weigh 189,000 pounds or almost 95 tons, which is within the weight capacity of the larger rail gondola cars. The volume of 225 increments at 12 feet$^3$ each is 2,700 feet$^3$, which is within the volume capacity of rail gondola cars that can handle 95 tons.

EXAMPLE D

The process parameters are the same as in Example A except that the reference composition specifies a maximum copper content of 0.10%, and an acceptable error on the mean for that specification is 0.02%. The number of increments 3 feet long required to obtain an error on the mean of 0.02% is $(0.45/0.02)^2=(22.5)^2$, which is about 506 increments that weigh 630 pounds each for a total weight of 318,700 pounds or almost 160 tons; this is a weight that exceeds the capacity of the largest rail gondola cars in common use (a capacity of about 109 tons).

In order to obtain a batch of material having an acceptable error on the mean of 0.02% and which can be accommodated in at least one of the larger rail gondola cars in common use, one can employ a number of expedients, alone or in combination, including: upgrading the internal characteristics of the analyzer to improve its accuracy; employing two analyzers in series; increasing the length of the activation region and making other appropriate changes to emulate, in one analyzer, the effect produced by two analyzers in series. Other expedients include (a) reducing the speed of the conveyor belt to increase the quantity of gamma rays detected for an increment of a given length, and (b) increasing the length of each increment so that a single increment emits more gamma rays, while at the same time reducing the depth of the increments and/or the density of the material in the increments to offset the increase in total batch weight that would otherwise be produced by increasing the length of 506 increments in the absence of the aforementioned offsetting expedients. The following examples illustrate some of the expedients described in the preceding part of this paragraph.

EXAMPLE E

The analyzer is upgraded to provide an error on the analyzer of 0.37%, but the other process parameters are the same as in Example D. The number of increments 3 feet long required to obtain an error on the mean of 0.02% is $(0.37/0.02)^2=(18.5)^2$, which is about 343 increments that weigh 630 pounds each, for a total weight of about 216,000 pounds, or 108 tons, which is within the weight capacity of one of the larger rail gondola cars commonly used to transport ferrous scrap. If the depth of the stream of increments is reduced from 12 inches to 8 inches, the weight of 343 increments is reduced to about 82 tons. If the density of the material is reduced from 70 pounds/foot$^3$ to 60 pounds/foot$^3$, the weight of the 343 increments will be about 93 tons, with a stream depth of 12 inches. The tonnages described in each of the preceding two sentences are each within the weight capacity of many rail gondola cars. In all variations described above in this paragraph, the volume of the tonnage described is believed to be within the volume capacity of the rail gondola car having a weight capacity that will accommodate the tonnage in question.

EXAMPLE F

The length of the increments is increased from 3 feet to 4.5 feet (a factor of 1.5), and the depth of the stream of increments is reduced from 12 inches to 8 inches. The other process parameters are the same as in Example D. Increasing the length of the increment by a factor of 1.5 increases the quantity of gamma rays detected for a given increment by 1.5 and, in effect, reduces the error on the analyzer by a factor of $\sqrt{1.5}=1.22$; under these circumstances, the effective error on the analyzer is reduced from 0.45 to about 0.37, and the number of increments required to obtain an error on the mean of 0.02 is about 343. Each such increment is 3 feet wide and has a length of 4.5 feet, a depth of 8 inches and a volume of 9 feet$^3$. At a density of 70 pounds/foot$^3$, each increment weighs 630 pounds, and 343 increments weigh about 216,000 pounds or 108 tons, which is within the weight capacity of one of the larger rail gondola car commonly used to transport ferrous scrap. The same rail car has a volume capacity capable of accommodating 343 increments of 9 feet$^3$ each (3,087 feet$^3$).

EXAMPLE G

The process parameters are the same as in Example D except that the speed of the conveyor belt is reduced by one-third, from one foot/second to 0.67 feet/second. (This has the same effect, from the standpoint of increasing the quantity of gamma rays detected for a given increment, as increasing the length of an increment from 3 feet to 4.5 feet (as in Example F).) As a result, the quantity of gamma rays detected for a given increment 3 feet long is increased by a factor of 1.5, which in effect reduces the error on the analyzer for that increment by $\sqrt{1.5}=1.22$, and the number of increments 3 feet long required to obtain an error on the mean of 0.02% is 343, as in Example F. Each of the 343 increments here has a volume of 9 feet$^3$ and a weight of 630 pounds, for a total batch weight of 108 tons, as in Example F. If the density of the material in this example (or in Example F) is reduced from 70 pounds/foot$^3$ to 60 pounds/foot$^3$, then the total batch weight would be about 93 tons.

EXAMPLE H

In this example, the error on the analyzer for an increment 3 feet long is 0.9% when the speed of the conveyor belt is 1 foot/second. Reducing the speed of the conveyor belt to 0.67 feet/second in effect reduces the error on the analyzer for an increment 3 feet long to 0.75%. The depth of the stream is 8 inches, and the material has a density of 55 pounds/foot$^3$. The reference composition specifies a copper content of at least 0.20%, and, as noted in Example A, an acceptable error on the mean for a copper content of 0.20% and above is 0.03%. Under these circumstances, the number of increments required to obtain an error on the mean of 0.03% is $(0.75/0.03)^2=(25)^2$, or 625. Each increment has a volume of 6 feet$^3$ and weighs 330 pounds; a batch of 625 increments weighs about 206,000 pounds, or 103 tons, which is within the weight capacity of the larger rail gondola cars commonly used to transport ferrous scrap. The volume of this batch is 3,750 feet$^3$, which can be accommodated in a high-sided rail gondola car having, e.g., sides 8 feet high (4,000 feet$^3$ capacity for a car 52-feet long), as well as having the required weight capacity for 103 tons.

In summary, in a method in accordance with those embodiments of the present invention that are described in the preceding examples, diverted increments of shredded ferrous scrap are accumulated in a diversion stockpile until the error on the mean for the specified copper content of the stockpiled increments is an acceptable value (e.g., 0.02% or 0.03%); and the process parameters of the method are selected so that a weight quantity (tonnage) of diverted increments in the diversion stockpile having an acceptable error on the mean corresponds to a unit shipment of ferrous scrap via land transportation (a rail gondola car).

EXAMPLE I

This example is directed to a stream of shredded ferrous scrap that has been picked clean, or nearly clean, of free copper. Such a stream typically has an average copper content of 0.14% upstream of the bulk sorting system, and wherein the copper content is primarily, if not entirely, metallurgically incorporated copper. At the bulk sorting system, increments having a mean copper content of 0.15% and above are diverted from the stream. One may assume an acceptable error on the mean of 0.025% for the diverted increments. The other process parameters can be the same as in (i) Example A or (ii) Example B. An acceptable error on the mean of 0.025% can be obtained with 324 increments each weighing 630 pounds, on average, for a total weight of about 102 tons, which can be accommodated in one of the larger rail gondola cars employed for a unit shipment of ferrous scrap. The shipment has a mean copper content that is greater than 0.15% and that may be greater than 0.20%. After sorting, the stream of undiverted increments has an average copper content substantially below 0.14%.

EXAMPLE J

The stream of shredded scrap metal is three feet wide and one foot thick. It moves at a speed of 1 foot/second. The stream comprises a mixture of non-ferrous scrap that has been separated from shredded ferrous scrap by magnetic separation and from which aluminum has been removed, leaving a mixture comprising copper, copper-base alloys including copper-zinc alloys, and zinc-base alloys. The mixture has a density approximately the same as that of shredded ferrous scrap, in this example 70 pounds/foot$^3$. The activation region of the analyzer is two feet long, and each increment is two feet long. The error on the analyzer is 1.1%. Each increment has a volume of six feet$^3$ and weighs 420 pounds.

In this Example J, diverted increments are accumulated in the stockpile until the stockpile contains at least the minimum weight quantity that can be transported in a standard size intermodal container (a unit shipment via land transportation for non-ferrous scrap). The standard size for an intermodal container, as determined by the International Organization for Standards (ISO), is 8 ft.×8 ft.×20 ft. (nominal), a volume of 1,280 foot$^3$. A standard size intermodal container can be carried on land by a semi-trailer or on a railroad car. An intermodal container having twice the standard size can be loaded on some semi-trailers, on a railroad car and on a ship. The number of increments that can be loaded into a standard size intermodal container depends upon the weight capacity of the semi-trailer that is to carry the container, which in turn depends upon the number of axles on the semi-trailer and on the back of the truck that is to pull the semi-trailer. Assuming one axle on each and a net permissible payload of 8,000 pounds per axle, the container can accommodate a net payload of 16,000 pounds, or 38 increments at 420 pounds per increment, with a total volume for that payload of 225 feet$^3$. A stockpile containing 38 increments has an error on the mean of 0.18%, which is well within an acceptable error on the mean (e.g., 1%) for a composition comprising no greater than 40% zinc (or 60-90% copper). If the truck has two rear axles and the semi-trailer has two axles, the container can be loaded with 32,000 pounds of shredded, non-ferrous scrap having the composition described above. This corresponds to 76 increments weighing 420 pounds each; and the error on the mean for this container-load would be about 0.13%.

The foregoing examples are to some extent idealized. In actual practice there would be some variation in the depth of the stream, and the stream's lateral cross-section would be slightly trough-shaped rather than precisely rectangular. Nevertheless, the examples do reflect substantially the substantive results one can expect in actual practice when employing processing parameters akin to those described in the examples.

As to each of the examples A-J described herein, one can employ bulk material analyzer 15 (FIGS. 1 and 3) to confirm the relevant mean chemical composition of the stockpile of diverted increments produced by the procedure of that example. One does so by conveying the stockpile as a continuous stream 17 through the same bulk material analyzer 15 as before, but this time the stream as a whole is analyzed in accordance with conventional analyzing practice as described above.

As previously noted, in preferred embodiments of the method of the present invention, the processing parameters of the method are selected so that (i) a weight quantity of diverted increments in the diversion stockpile, having an acceptable error on the mean, corresponds to (ii) a unit shipment of scrap via land transportation. There is an advantage to selecting the processing parameters in this manner: one has the option to sell and ship scrap from the diversion stockpile when the weight of the stockpile corresponds to one unit shipment, or one has the option to wait, before selling and shipping, until the size of the diversion stockpile corresponds to two or more unit shipments; or in the case of ferrous scrap, one has the option to wait until the size of that stockpile corresponds to a barge load. The flexibility, in selling and shipping scrap from the diversion stockpile, that is available to one who selects processing parameters in the manner described above, is not available to one who does not select processing parameters in that manner.

Shredded ferrous scrap is typically part of the charge for an electric arc furnace wherein typically either the totality of the charge or a majority of the charge is ferrous scrap. Shredded ferrous scrap may also be part of the charge for a basic oxygen furnace wherein typically a smaller fraction of the charge (e.g., 25%) is ferrous scrap.

With respect to the electric are furnace, there are many such furnaces that will accommodate a ferrous scrap charge up to 85 tons, and there are many other such furnaces that will accommodate a ferrous scrap charge up to 120 tons. In many of the examples described several paragraphs above, the quantity of copper-containing shredded ferrous scrap increments, having an acceptable error on the mean for copper content, not only (a) correspond to a unit shipment of ferrous scrap via land transportation but also, (b) is less than the ferrous scrap charge for an electric furnace.

Some parts of the foregoing discussion directed to shredded ferrous scrap were concerned with the error on the mean for an accumulation of shredded ferrous scrap containing a copper content (a) less than 0.10% or (b) 0.20% or more. With respect to diverted increments of shredded ferrous scrap containing 0.20% or more of one or more of the alloying ingredients chromium, nickel and molybdenum, the considerations regarding the error on the mean are the same as for shredded ferrous scrap containing a copper content of 0.20% or more. With respect to diverted increments of shredded ferrous scrap containing manganese or silicon in respective amounts greater than that contained in plain carbon steel (i.e., greater than 1.65% Mn and 0.60% Si), an acceptable error on the mean would be 0.04% for manganese and 0.05% for silicon.

With regard to increments diverted from mixtures of shredded non-ferrous scrap to stockpiles for use in producing brass casting alloys, the considerations involving the error on the mean are much less demanding than for shredded ferrous scrap containing mean copper contents of (a) no greater than 0.10% or (b) 0.20% or more, wherein the respective errors on the mean are 0.02% and 0.03%. In the case of brass casting alloys, the tolerance for zinc in yellow brass casting alloys is 3-5% for a nominal zinc content in the range 24-40%, and 1-2% for semi-red brasses (9-15% nominal zinc content) and red brasses (4-10% nominal zinc content).

Stockpiles of shredded non-ferrous scrap employed to produce the brass casting alloys described above can have an acceptable error on the mean corresponding to the tolerances for zinc content noted in the preceding paragraph, e.g., 1% for red and semi-red brasses and 3% for yellow brass. These are acceptable errors on the mean that are two orders of magnitude greater than the acceptable errors on the mean for stockpiles of shredded, copper-containing ferrous scrap (errors on the mean of 0.02% or 0.03%). The tolerances (and corresponding acceptable errors on the mean) for copper in brass casting alloys are of the same order of magnitude as the tolerances for zinc.

The relatively large magnitude of the error on the mean acceptable for stockpiles of shredded scrap used for producing brass casting alloys is one reason why the equipment required for analyzing and sorting increments diverted to these stockpiles need not be as sophisticated and fine-tuned as the equipment required for analyzing and sorting copper-containing shredded ferrous scrap.

The considerations involved in dividing continuous stream 17 into end-to-end increments 18,18, and in the calculation of the bulk chemical composition of each increment 18, will now be discussed with reference to FIGS. 1 and 3.

Activation region 29 in analyzer 15 has a known dimension in the lengthwise (i.e., downstream) direction of stream 17, and increment 18 has a pre-selected lengthwise dimension (l) greater than that of activation region 29, but otherwise relatively small (e.g., less than the lengthwise dimension (L) of bulk material analyzer 15 (FIG. 1). Preferably, all increments 18,18 have the same lengthwise dimension.

In some embodiments, the ratio of (1), the lengthwise dimension of increment 18, to (c) the lengthwise (i.e., downstream) dimension of activation region 29 (i.e., (1)/(c)) is in the range 1.1-2.5. In other embodiments, the ratio of (1) to (c) is in the range 2-5, for example. One will note that, in all these examples, the increments are provided with a lengthwise dimension having the same order of magnitude as the lengthwise dimension of the activation region.

The lengthwise dimensions of activation region 29 and increment 18 are inputs into processor 19. Other inputs into processor 19 include the speed of conveyor belt 12 and timing information from a timing indicator 24 (FIG. 3) which is initially turned off but which, when turned on, provides processor 19 with a running time measurement.

Figure 3:
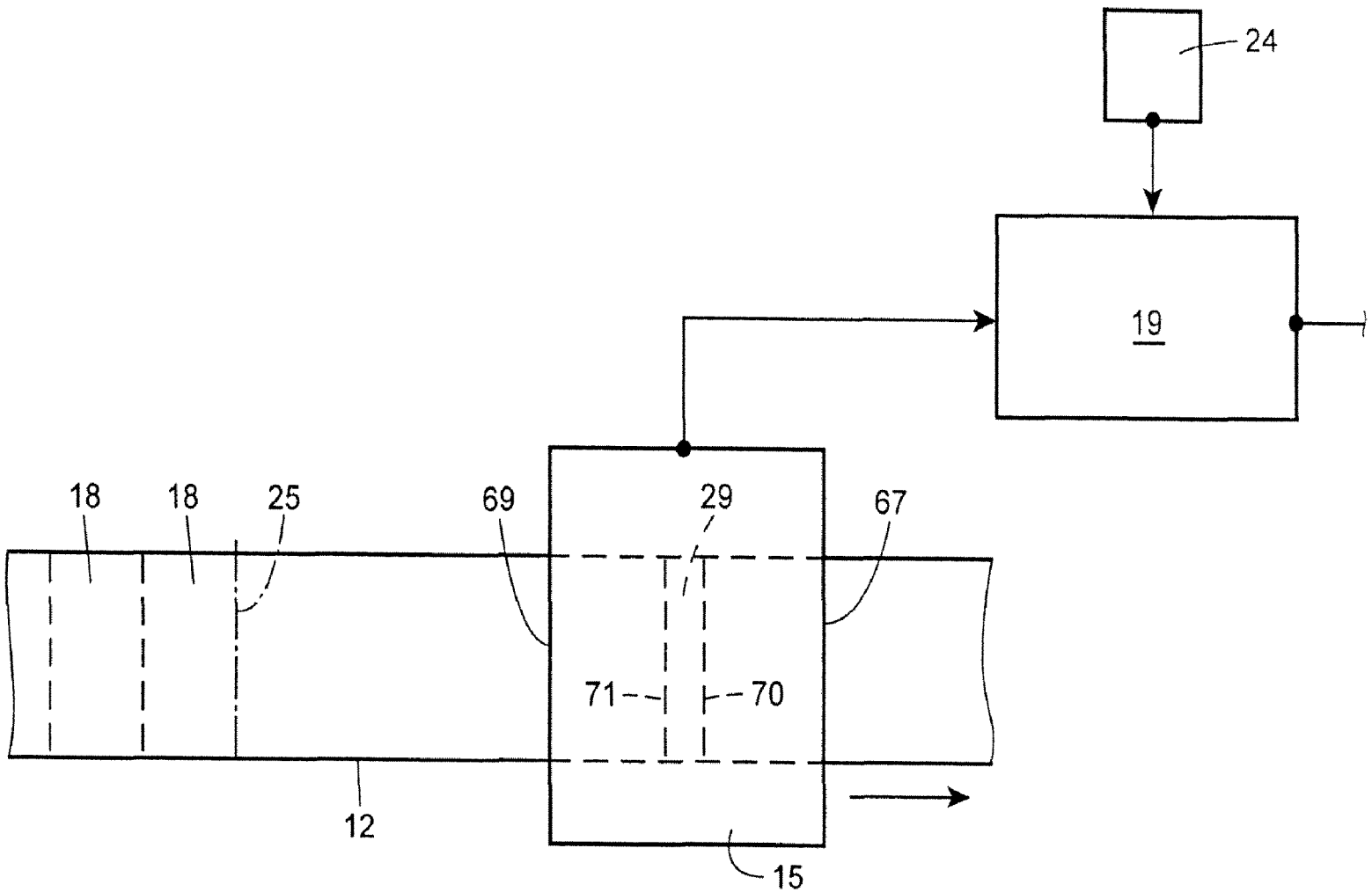
FIG. 3 is an enlarged fragment of the flow diagram of FIG. 1.

Referring to FIG. 3, a reference location, shown in dash-dot lines at 25, is positioned a known distance upstream of the downstream end 70 of activation region 29, and this distance is an input into processor 19. When timer 24 is turned on, a vertical plane extending through stream 17 at reference location 25 defines the downstream end of the first increment 18 in stream 17 that is to be analyzed by analyzer 15 and processed by processor 19. As noted above, the inputs to processor 19 also include the pre-selected lengthwise dimension of increments 18,18, the conveyor belt speed and a running time measurement. Given the inputs described in this paragraph, the processor can divide stream 17 into increments 18,18 and can determine the location in moving stream 17 of each increment 18,18 at all relevant times. One will note from the foregoing description that stream 17 is divided into increments 18,18 without reference to the chemical composition of the stream.

As noted above, the inputs to processor 19 include (a) conveyor belt speed and (b) the distance between (i) reference location 25 and (ii) downstream end 70 of activation region 29. Accordingly, processor 19 can predict the time it will take for the downstream end of first increment 18 to move from reference location 25 to the activation region's downstream end 70. For example, if distance (b) is ten feet and the belt speed is one foot per second, the time in question would be ten seconds. Once timing indicator 24 is turned on and processor 19 receives a running time measurement therefrom, processor 19 can determine when the time in question has elapsed, and at that time processor 19 will begin calculating the bulk (i.e., average) chemical composition of first increment 18 from the analyses processor 19 is receiving from bulk material analyzer 15.

Figure 4:
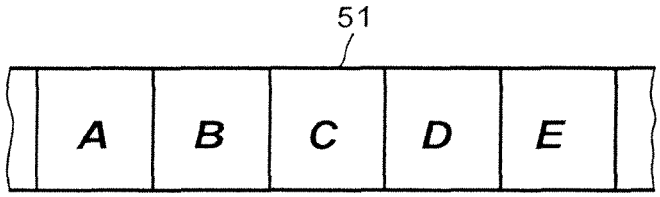
FIG. 4 is a fragmentary plan view illustrating a segment of a stream of shredded scrap metal.

Processor 19 makes this calculation by averaging all the real time analyses received by the processor between (i) the time when the downstream end of first increment 18 arrives at downstream end 70 of activation region 29 and (ii) the time when the upstream end of that increment arrives at downstream end 70 (FIG. 4). When the downstream end of first increment 18 is at downstream end 70 of activation region 29, the upstream end of that increment is upstream of the activation region's upstream end 71; this is because the lengthwise dimension of increment 18 is greater than the corresponding dimension of activation region 29. As noted above, both of these dimensions are inputs into processor 19, as is conveyor belt speed and a running time measurement from indicator 24. Given the inputs described in the preceding sentence, processor 19 can determine (a) when the upstream end of first increment 18 will arrive at upstream end 71 of activation region 29 and (b) when the upstream end of that increment will arrive at downstream end 70 of the activation region, and (c) when the upstream end of the increment will be at any part in-between.

Because the increments 18,18 in continuous stream 17 are in end-to-end relation, the upstream end of one increment is the same as the downstream end of the adjoining upstream increment. As a result, there will be a period of time when a portion of each of these two increments will be in activation region 29 at the same time. Processor 19 is programmed to take this into account when calculating the mean chemical composition of each increment.

More particularly, the processor allocates, between the two increments, each analysis received at a time when the activation region is occupied by portions of both increments, with the allocation to each increment being proportional to the fraction of the activation region occupied by that increment at the time the analysis is made. For example, assume that a chemical analysis is made at a time when each increment occupies one-half (50%) of the activation region. In such a case, each increment is allocated 50% of the chemical analysis made at that time; i.e., the percentage of a chemical element obtained by the analysis and allocated to each increment is weighted at 50% of what the percentage would be if the entire activation region had been occupied by that increment. Thus, if the copper content for that analysis is 0.20%, the allocation to each increment is 0.10% copper, which is then averaged with the copper contents from the other analyses of that increment to determine the mean (average) copper content of the increment. Similarly, if at the time of an analysis, an increment occupied 75% of the activation region, that increment would be allocated 75% of the copper content obtained by the analysis (e.g., 0.15% copper for an analysis measurement of 0.20% copper).

Thus, for any given increment, a calculation of that increment's mean chemical composition incorporates (a) analyses received by the processor when that increment occupies the entire activation region and (b) analyses received by the processor when the increment occupies various fractions of the activation region, with the latter group of analyses being appropriately weighted, as described above.

The procedures described above are repeated for each increment 18 in stream 17.

The distance between (i) downstream end 70 of activation region 29 and (ii) bulk sorting system 16 is an input into processor 19. This input together with other, previously described inputs, including belt speed, increment length and a running time measurement, enable the processor to track the location of any given increment 18 as it moves downstream toward bulk sorting system 16. The lines defining end-to-end increments 18,18 in FIG. 1 are, of course, not physically visible, but their locations are known to processor 19 at all relevant times. When a given increment 18 arrives at sorter 16, the sorter mechanically processes the increment in accordance with an instruction from information processor 19 based on the bulk chemical composition of that increment.

Referring to FIG. 3, in another embodiment of the present invention, the reference location is at the downstream end 70 of activation region 29. At the time that timer 24 is turned on, a vertical plane extending through stream 17 at location 70 defines the downstream end of the first increment to be analyzed. Other than the position of the reference location, the inputs to processor 19 are the same as in the previously described embodiment.

In a variation of the embodiment described in the immediately preceding paragraph, the reference location is at upstream end 71 of activation region 29. At the time that timer 24 is turned on, a vertical plane extending through stream 17 at location 71 defines the downstream end of the first increment to be analyzed. Aside from the position of the reference location, the inputs into processor 19 are the same as in the two previously described embodiments.

Referring again to FIG. 1, the distance between bulk analyzer 15 and bulk sorting system 16 is greater than the length of an increment 18, i.e., greater than the increment's dimension in the lengthwise or downstream direction of the stream. Preferably, the distance between analyzer 15 and sorting system 16 is a large multiple of the increment's length. Examples of increment length include: (a) in the range one foot to five feet; and (b) in the range five feet to ten feet. Examples of the distance between analyzer 15 and sorter 16 include: (a) up to twenty feet; (b) in the range twenty feet to forty feet; and (c) in the range forty feet to one hundred feet, or more.

The length of an increment preferably is as small as is practicable given the restraints imposed by the structure and operation of apparatus 11. As discussed below, with an increment of relatively small length, there are sorting efficiencies not available with an increment of greater length. As used herein, the term "an increment of relatively small length" refers to an increment having a length no greater than five feet.

More particularly, referring to FIG. 4, illustrated therein is a stream segment 51 having five sub-segments A-E, each one-fifth the length of segment 51. In the examples discussed below, segment 51 has an average copper content typical of a batch of shredded ferrous scrap that has been analyzed by analyzer 15 (e.g., 0.14% copper). The average copper content of a given sub-segment in the group A-E may approximate the average copper content of segment 51, or a sub-segment's average copper content may vary somewhat from the segment's average copper content, as tabulated below:

| | AVERAGE COPPER CONTENT, % | | |
|---|---|---|---|
| SUB-SEGMENT | EXAMPLE I | EXAMPLE II | EXAMPLE III |
| A | 0.14 | 0.16 | 0.24 |
| B | 0.16 | 0.15 | 0.16 |
| C | 0.10 | 0.13 | 0.11 |
| D | 0.09 | 0.18 | 0.10 |
| E | 0.21 | 0.10 | 0.09 |
| Segment 51 | 0.14 | 0.14 | 0.14 |

If, in the foregoing examples, the selected length of an increment is that of segment 51, then in each of examples I-III, the increment (i.e., segment 51) has an average copper content of 0.14% and would qualify for a small payment premium from a maker of flat rolled steel. However, if the selected length of an increment is that of sub-segments A-E (each of which is one-fifth the length of segment 51), the shredded ferrous scrap in segment 51 takes on increased value.

In Example I, sub-segments C and D may be diverted to a stockpile for high value, low copper content, shredded ferrous scrap (arrow 20 in FIG. 1). Sub-segment E may be diverted and stockpiled with other diverted increments having a copper content above 0.20% (arrow 23), for eventual sale to a steelmaker whose products require a high copper content (e.g., corrosion-resistant steel). Undiverted sub-segments A and B (arrow 21) together have an average copper content of 0.15% which can be guaranteed by one who operates an apparatus 11 in accordance with the present invention, and as such, may still entitle combined sub-segments A and B to a small payment premium. Diverting sub-segment E from undiverted sub-segments A and B, reduces the average copper content of the undiverted segments from 0.17% (with sub-segment E) to 0.15% (without sub-segment E).

In Example II, sub-segment E (0.10% copper) is diverted to the stockpile for high value, low copper content, shredded ferrous scrap (arrow 20); and the average copper content of all the undiverted segments (A-D) is 0.155%, an average copper content that can be guaranteed.

On the face of Example III, only sub-segments D and E qualify to be diverted (arrow 20) to the high value, low copper content stockpile (0.10% maximum average copper content). However, sub-segment C (0.11% copper) can be averaged with sub-segment E (0.09% copper), for a combined average copper content of 0.10%, and all three sub-segments C-E can then be diverted to the low copper content stockpile (0.10% maximum average copper content) without adversely affecting that stockpile's maximum average copper content. Of the remaining sub-segments in Example III, sub-segment A (0.24% copper) will be diverted to the stockpile for increments having a copper content above 0.20% (arrow 23). The only undiverted sub-segment is sub-segment B which will have an acceptable guaranteed copper content of 0.16%.

In one embodiment of the invention, only those increments with a higher copper content are diverted from the stream, e.g., sub-segment E in Example I and sub-segment A in Example III. In each such case, the respective bulk copper contents of Examples I and III, after removal of only the sub-segments with the higher copper contents, are as follows: Example I=0.1225% copper and Example III=0.115% copper. In both examples the average (bulk) copper content of the stream was reduced from 0.14%, the average copper content of segment 51.

Examples I-III may be more idealized than what will be encountered in actual practice. Nevertheless, these examples do illustrate (a) the type of divertible increments one can encounter when one employs the smaller increment length of sub-segments A-E, instead of the larger increment length of segment 51, and they also illustrate (b) the increased sorting efficiencies one can achieve when one employs a smaller increment length.

In accordance with a preferred embodiment of the present invention, each of the increments 18,18 in stream 17 has the same, predetermined dimension in a downstream direction and sorting decisions are made at regular periodic intervals, multiple times per minute. Thus, for increments having a downstream dimension of three feet or five feet or ten feet, a sorting decision is made, respectively, twenty times per minute, or twelve times per minute or six times per minute.

Figure 5:
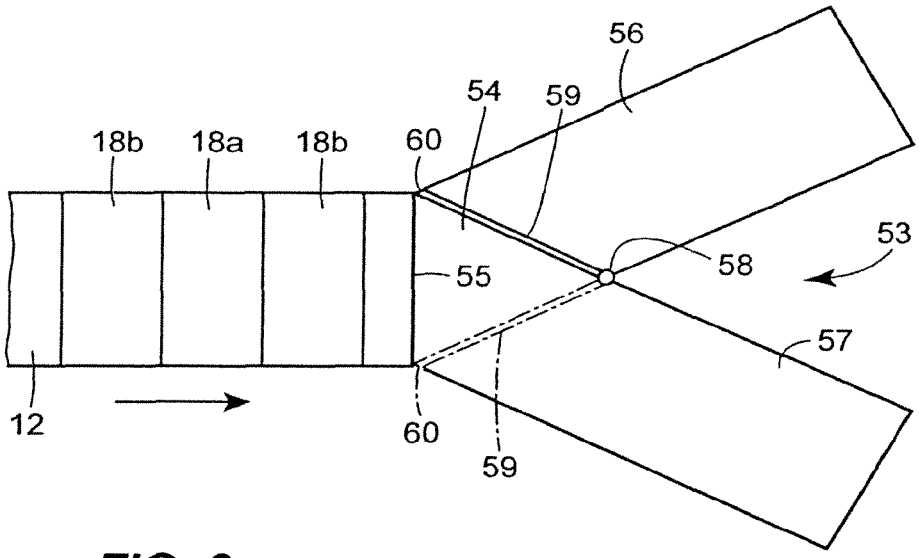
FIG. 5 is a plan view of one type of sorting equipment that may be used in performing the method of the present invention.
Figure 8:
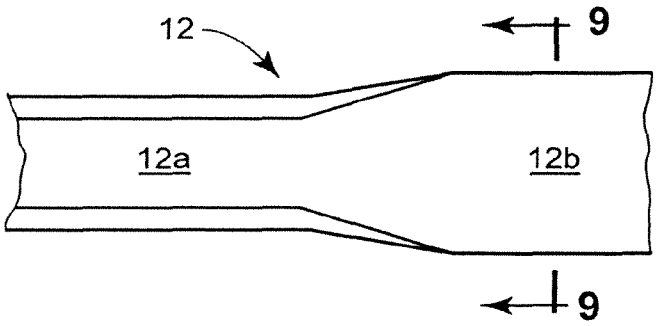
FIG. 8 is a fragmentary plan view of a conveyor belt used in conjunction with the equipment of FIG. 7.
Figure 9:
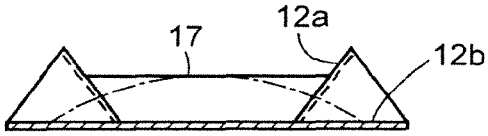
FIG. 9 is a sectional view, partially in phantom, taken along line 9-9 in FIG. 8.

Referring now to bulk sorting system 16 (FIG. 1), FIGS. 5-9 illustrate some examples of such a system. Referring initially to FIG. 5, indicated generally at 53 is an inclined ramp assembly constituting part of bulk sorting system 16 and having an upstream portion 54 communicating with the downstream end 55 of conveyor belt 12, below belt 12. Upstream ramp portion 54 is inclined downwardly in a downstream direction and splits into a pair of downwardly inclined, divergent ramp portions 56,57. Pivotally mounted at the junction of divergent ramp portions 56,57 is a pivot shaft 58 to which is fixed the inner end of a guide member 59 having an unfixed outer end 60. Guide member 59 is mounted for pivotal movement, with shaft 58, between a first position (solid lines in FIG. 6), for diverting an increment, e.g., 18*b* in FIG. 5, toward ramp portion 57, and a second position (dash-dot lines in FIG. 6) for diverting an increment, 18*a* in FIG. 5, toward ramp portion 56. Shaft 58 may be driven by a motor or by a compressed air piston assembly or the like (not shown) actuated by a signal from processor 19 (FIGS. 1 and 3).

Conforming increments (e.g., 18*a* in FIG. 5) are diverted onto ramp portion 56 while non-conforming increments 18*b* are directed onto ramp portion 57. Guide member 59 is moved from the position shown in full lines in FIG. 5 to the position shown in dash-dot lines, in response to a signal from processor 19, when the upstream end of non-conforming increment 18*b* enters ramp portion 54.

Figure 6:
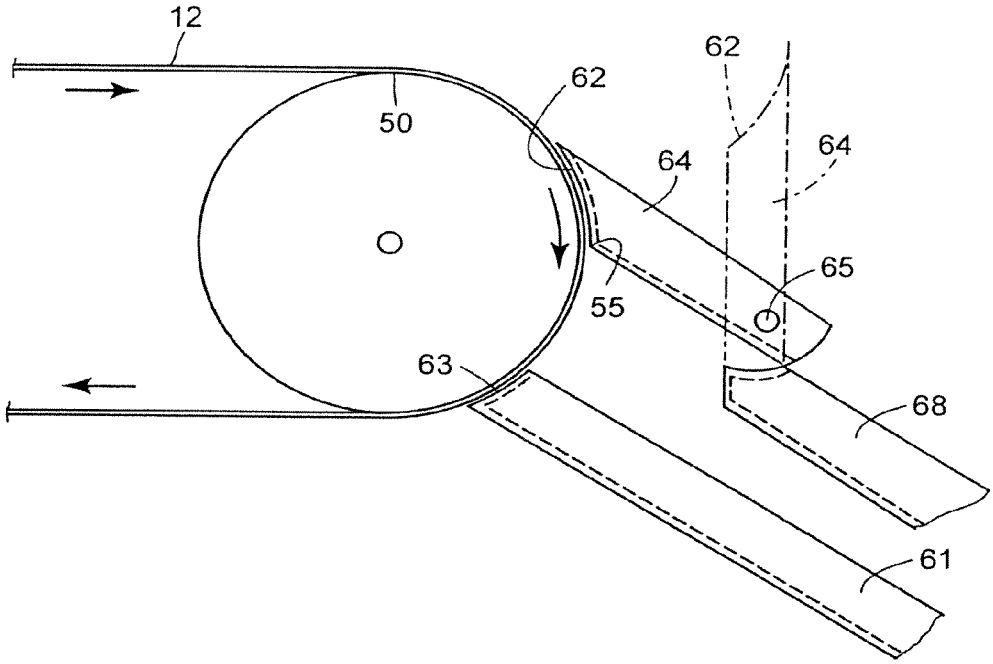
FIG. 6 is a side elevational view of another type of sorting equipment that may be used.

FIG. 6 illustrates another example of a diverter arrangement employed in the present invention and comprising a pair of parallel, inclined upper and lower ramps 68,61, respectively. Each ramp has a respective upstream end 62, 63 disposed to receive shredded scrap delivered off the downstream end 55, of conveyor belt 12. Upper ramp 68 has a moveable, upstream end portion 64 that is stepped-up relative to the rest of upper ramp 68 and that is pivotally mounted at 65 for movement between a lowered, operative position, illustrated in full lines in FIG. 6, and a raised, inoperative position illustrated in dash-dot lines in FIG. 6. When end portion 64 of upper ramp 68 is in its lowered, operative position, shredded scrap is delivered off conveyor belt 12 onto upper ramp 68. When end portion 64 is in its raised, inoperative position, shredded scrap is delivered off conveyor belt 12 onto lower ramp 61.

Ramp portion 64 is raised and lowered by a conventional mechanism (not shown) in response to a signal from processor 19 (FIG. 1). Ramp portion 64 is maintained in its lowered position to receive non-conforming increments delivered off the conveyor belt. Ramp portion 64 is raised when the upstream end of a non-conforming increment arrives at upstream end 62 of upper ramp 68, so as to enable the conforming increments to be delivered onto lower ramp 61. The mechanism for raising and lowering ramp portion 64 may be pneumatically or hydraulically or mechanically driven in a conventional manner (not shown).

Figure 7:
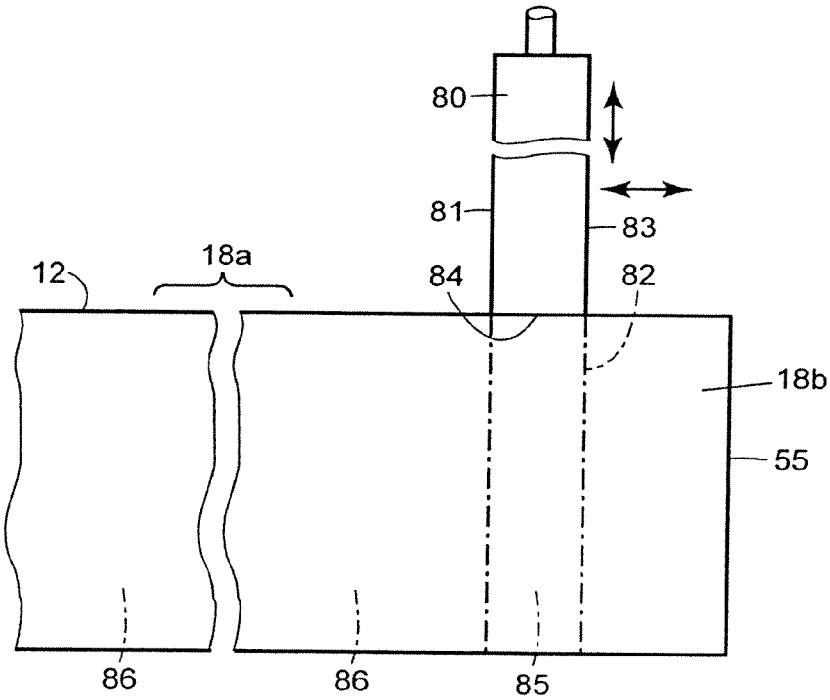
FIG. 7 is a plan view of a piece of sorting equipment that may be used in conjunction with the equipment of FIGS. 5 and 6.

FIG. 7 illustrates an arrangement for spacing apart a pair of adjoining increments 18*a*, 18*b*, e.g., when one of the adjoining increments (18*a*) is to be diverted and the other increment (18*b*) is not. For illustrative purposes, the increments may be assumed to be three feet long. Located a short distance (e.g., several inches) upstream of the downstream end 55 of conveyor belt 12 is a pusher-type diverter 80 having a pair of opposed side surfaces 81, 83. Diverter 80 is mounted (a) for reciprocal transverse movement across conveyor belt 12 and also (b) for reciprocal, longitudinal movement along conveyor belt 12. When the dividing line 82 between a pair of adjoining moving increments 18*a*, 18*b* becomes aligned with the downstream side surface 83 of diverter 80, the diverter is actuated by processor 19, (a) to move transversely across conveyor belt 12 and (b) to move downstream along belt 12, at the same downstream speed as belt 12. The forward end 84 of diverter 80 is a ram which is a few inches wide and which engages upstream increment 18*a* at its downstream end portion 85 and pushes the downstream end portion of increment 18*a* off of conveyor belt 12, thereby spacing the unpushed remainder 86 of upstream increment 18*a* from any contiguity with downstream increment 18*b*.

When the downstream end portion 85 of increment 18*a* has been pushed off conveyor belt 12, diverter 80 is retracted transversely back across conveyor belt 12 and then retracted longitudinally back upstream along belt 12 to the original, starting position of diverter 80. The two-stage transverse movement of diverter 80 across the conveyor belt and back is relatively rapid compared to the simultaneous downstream movement of conveyor belt 12 and diverter 80, so that pusher-type diverter 80 is extended and retracted before the downstream end 82 of increment portion 85 arrives at location 50 (FIG. 6) on the conveyor belt. Location 50 is where the belt's downstream movement changes from, e.g., horizontal movement to movement having a downward component. Location 50 is an input into processor 19. The relatively rapid transverse movement of diverter 80 may be pneumatically or hydraulically or mechanically driven, all in a conventional manner (not shown); the longitudinal movement of diverter 80 along conveyor belt 12 similarly may be conventionally driven (not shown).

The procedure described in the preceding two paragraphs is intended to space apart two increments, 18*a* and 18*b*, having different compositions. If desired, two increments 18,18 having the same composition (whether conforming or non-conforming) may be spaced apart using the same procedure.

Referring now to all of FIGS. 5-7, downstream increment 18*b* (FIG. 7) is directed along ramp portion 57 in FIG. 5 and along upper ramp 68 in FIG. 6. The unpushed remainder 86 of upstream increment 18*a* (FIG. 7) is diverted along ramp portion 56 in FIG. 5 and along lower ramp 61 in FIG. 6. The downstream portion 85 of increment 18*a* (FIG. 7) that had been pushed transversely off conveyor belt 12 is rejoined with the remainder 86 of increment 18*a*, downstream of conveyor belt 12, employing conventional transporting equipment (e.g., ramps, conveyor belts or the like, not shown).

Spacing apart downstream increment 18*b* from upstream increment 18*a*, in the manner described above, has the following advantages. It gives movable guide member 59 of diverter 53 (FIG. 5) increased time to move, from the position shown in full lines in FIG. 5 to the position shown in dash-dot lines, after the upstream end of downstream increment 18*b* has entered ramp portion 54 but before the remainder 86 of upstream increment 18*a* can do so. Similarly, spacing apart increments 18*a* and 18*b* gives moveable, upstream end portion 64 of upper ramp 68 (FIG. 6) increased time to move, from its lowered position to its raised position, after the upstream end 82 of downstream increment 18*b* has moved onto upper ramp 68 but before remainder 86 of upstream increment 18*a* can do so.

Pusher-type diverter 80 ejects increments carried on a flat conveyor belt. Typically, a stream of shredded scrap metal undergoing analysis at a bulk material analyzer (PGNAA) is carried on a trough-shaped conveyor belt. In such a case, before an increment can be ejected by pusher-type diverter 80, the conveyor belt has to undergo a transition in its lateral, cross-sectional shape from (a) trough-shaped (shown at 12*a* in FIGS. 8 and 9) to (b) flat or planar shaped (shown at 12*b* in FIGS. 8 and 9). When this occurs, the cross sectional shape of stream 17 carried by conveyor belt 12 will also undergo a change in shape, from trough-shaped (solid lines in FIG. 9) to mound-shaped (dash-dot lines in FIG. 9).

Each of divergent ramp portions 56, 57 in FIG. 5, and each of upper and lower ramps 68, 61 in FIG. 6, may terminate at a respective downstream conveyor belt (not shown) for carrying an increment to its intended destination, e.g., to an accumulation location for the undiverted, non-conforming increments or to a diversion stockpile for the diverted, conforming increments.

Diverted increments conforming to each of two different predetermined reference compositions may, in some circumstances, initially be diverted to the same downstream conveyor belt. At that conveyor belt, increments conforming to one of the two reference compositions are removed, e.g., with a drum electromagnet (when an increment is shredded ferrous scrap), in turn communicating with its own downstream conveyor belt. An example of a drum electromagnet as well as other examples of electromagnets that may be employed for similar purposes are illustrated in Nijkerk, supra, at page 155 (Figs. VI-4-2), and the description therein is incorporated herein by reference. The electromagnet is activated at the appropriate time by a signal from processor 19 which keeps track of the location of each increment 18. An increment conforming to one reference composition is spaced apart from an increment conforming to the other reference composition either (a) because these increments were initially separated by one or more non-conforming increments upstream of bulk sorting system 16 or (b) by virtue of the operation of diverter 80 (FIG. 7).

In addition to the diverters described above and illustrated in FIGS. 5-9, other appropriate diverters will suggest themselves to those skilled in the art of bulk sorting systems and who have been provided with the disclosure herein.

As noted above, the present invention includes an embodiment that is directed to sorting a stream of increments in which (i) an increment having a conforming composition has been spaced apart from (ii) an increment having a non-conforming composition and from (iii) an increment having a different conforming composition, and in which the spacing step has been performed at a bulk sorting system (e.g., by diverter 80 (FIG. 7)). The invention is also applicable to sorting a stream in which the increments may be spaced apart at a location upstream of the bulk sorting system, or even upstream of the bulk analyzing system.

The invention is described above in the context of bulk sorting shredded scrap metal. In a broader sense, the invention is also applicable to other particulized materials in a stream, either metallic or non-metallic, so long as the stream of particulized material can be sorted employing the steps of: (a) dividing the stream into relatively small bulk increments; (b) determining the bulk chemical composition of each increment in the stream, using a bulk material analyzer; and (c) sorting the increments on the basis of the bulk chemical composition of each increment.

As used herein, the term "particulized material" refers to a material that has been subjected to a particulizing operation or that is present in a particulized state, either natural or otherwise. A particulizing operation is one that converts a relatively large piece of material into relatively small pieces and may include shredding, fragmenting, fracturing, shearing, crushing, grinding, impacting, cutting, tumbling, breaking, blasting apart with explosives, and the like.

The present invention is especially applicable to the processing of a stream of particulized material comprising one or more ingredients, either desirable or undesirable, that are non-uniformly distributed along the length of the stream. In processing such a material, one makes a real-time determination of the percentage, in each increment, of a non-uniformly distributed ingredient, using a bulk material analyzer (e.g., a PGNAA); and one then subjects the increments to further processing (e.g., sorting) on the basis of the percentage, in each increment, of the non-uniformly distributed ingredient. Sorted increments are diverted to a stockpile where the diverted increments are accumulated at least until the error on the mean for the relevant ingredient in the diverted increments is an acceptable value. Preferably, the processing parameters are selected so that a weight quantity of diverted increments in the diversion stockpile, having an acceptable error on the mean, corresponds to a unit shipment via land transportation.

As used herein, a unit shipment via land transportation refers to: (i) a standard size intermodal container, for shredded non-ferrous scrap (or other particulized material of equivalent or higher value); (ii) a rail gondola car, for shredded ferrous scrap; and (iii) a rail gondola car, or other rail car, for particulized material having a value equivalent to or less than that of shredded ferrous scrap. Non-metallic, particulized materials amenable to processing by the present invention comprise, for example, ores, solid fuels and other minerals that include an ingredient it is desirable to remove or isolate by sorting.

As used herein, the term "bulk material analyzer" refers to a piece of equipment, such as a PGNAA, that provides real-time analyses of the chemical composition of a moving stream of particulized material.

The foregoing detailed description is a projection; it has been given for clearness of understanding only, and no unnecessary limitations should be understood therefrom, as modifications will be obvious therefrom to those skilled in the art.

The invention claimed is:

1. A method for processing a moving stream of particulized material, said method comprising the steps of:

conveying a moving stream of particulized material downstream along a processing path having upstream and downstream ends;

providing a bulk material analyzing system along said path upstream of said downstream end;

dividing said moving stream into a series of dimensionally predetermined bulk sorting increments in abutting, end-to-end relation, each increment comprising a multiplicity of individual, unadhered fragments of particulized material disposed in multiple layers;

employing said bulk material analyzing system to provide a real-time analysis of the bulk chemical composition of each dimensionally predetermined sorting increment in said stream, as the stream undergoes movement;

providing a sorting location downstream of the bulk material analyzing system;

maintaining and tracking said dimensionally predetermined sorting increments downstream of the bulk material analyzing system and up to said sorting location;

and then sorting said dimensionally predetermined sorting increments on the basis of their respective bulk chemical compositions;

the dimension, in a downstream direction, of each increment undergoing sorting being predetermined before that increment undergoes chemical analysis.

2. A method as recited in claim 1 wherein:

said stream is divided into said increments at predetermined intervals;

and said sorting step is performed in accordance with sorting determinations made at predetermined intervals corresponding to the intervals at which said stream is divided into increments.

3. A method as recited in claim 2 wherein:

each sorting determination is based on the bulk chemical composition of a single respective increment in said stream of abutting increments.

4. A method as recited in claim 2 wherein:

said increments are sorted in response to sorting determinations made at regular intervals multiple times per minute.

5. A method as recited in claim 1 wherein:

said step of dividing the stream into increments is performed upstream of where said sorting step is performed and without reference to the chemical composition of the stream.

6. A method for sorting particulized material on other than a piece-by-piece basis, said method comprising the steps recited in claim 1, and wherein:

said analyzing and sorting steps are performed without spacing apart the individual fragments of particulized material; and each fragment in an increment is in contact with other fragments in that increment, in horizontal and vertical directions.

7. A method as recited in claim 1 wherein:

said stream is conveyed downstream toward an accumulation location at which said particulized material is accumulated;

said sorting step comprises diverting, from said stream, increments having a bulk chemical composition conforming to at least one predetermined reference composition;

said conforming increments being intermixed in said stream with abutting, non-conforming increments upstream of the location where said sorting step is performed;

and said method comprises diverting said conforming increments from the intermixture of conforming and non-conforming increments and directing non-conforming increments, from said intermixture, downstream from the sorting location toward said accumulation location.

8. A method as recited in claim 7 wherein:

said diverted increments are accumulated in a diversion stockpile;

said predetermined reference composition has at least one predetermined compositional specification; and said diverted increments are accumulated in said diversion stockpile at least until the error on the mean for said predetermined compositional specification is an acceptable value.

9. A method as recited in claim 8 and comprising:

selecting processing parameters for said method so that a weight quantity of diverted increments in said diversion stockpile having said acceptable error on the mean corresponds to a unit shipment via land transportation.

10. A method as recited in claim 1 wherein said sorting step comprises:

diverting from said stream each increment conforming to a predetermined reference composition;

said diverting step being performed in accordance with a sorting determination that is made without reference to the average chemical composition of that part of the stream which is downstream of the conforming increment.

11. A method as recited in claim 1 wherein said particulized material is shredded scrap metal and said method comprises:

conveying said stream of shredded scrap metal downstream along said processing path toward an accumulation location at which said shredded scrap metal is accumulated;

locating said bulk analyzing system upstream of said accumulation location;

performing said sorting step at a bulk sorting system located along said path between said bulk analyzing system and said accumulation location;

diverting from said stream, at said bulk sorting system, increments having a bulk chemical composition conforming to at least one predetermined reference composition;

said conforming increments being intermixed in said stream with non-conforming increments upstream of said bulk sorting system.

12. A method as recited in claim 11 wherein:

said diverted increments are directed to a stockpile for diverted increments;

said reference composition specifies a minimum content, for a metallic element in said stream, which is above the mean content of said element in that part of the stream of shredded scrap metal which is upstream of said bulk material analyzing system;

and the mean content of said metallic element, in said stockpile of diverted increments, is at least the minimum content specified by said reference composition.

13. A method as recited in claim 12 wherein:

said shredded scrap metal is shredded ferrous scrap;

said metallic element is copper;

said stream has been processed at a shredder upstream of said path;

at least some of said diverted increments contain free copper;

and said method further comprises recycling the diverted increments containing free copper back to said shredder for further processing.

14. A method as recited in claim 12 wherein:

said shredded scrap metal is shredded ferrous scrap;

said metallic element is copper;

said stream of shredded ferrous scrap has undergone a free copper-removing step upstream of said bulk material analyzing system, to remove free copper from said stream;

said stream comprises increments containing metallurgically incorporated copper;

and said diverting step comprises diverting from said stream at least some of the increments containing metallurgically incorporated copper, thereby to reduce, by sorting, the mean copper content of the shredded ferrous scrap accumulated at said accumulation location.

15. A method as recited in claim 14 wherein:

said stream of shredded ferrous scrap has a mean copper content, after said free copper-removing step and before said diverting step, in the range 0.12-0.16%;

the diverted increments have a mean copper content greater than the copper content of said stream before the diverting step;

and the mean copper content of the shredded ferrous scrap at said accumulation location is less than the mean copper content of the stream before said diverting step, and less than 0.14%.

16. A method as recited in claim 11 wherein:

said shredded scrap metal is shredded ferrous scrap containing copper;

said reference composition specifies a copper content that differs from the mean copper content in that part of the stream of shredded ferrous scrap that is upstream of said bulk sorting system;

and said diverted increments are accumulated in a diversion stockpile until the error on the mean for the copper content of the stockpiled increments is an acceptable value.

17. A method as recited in claim 16 wherein said method comprises:

selecting the processing parameters of said method so that a weight quantity of diverted increments in said diversion stockpile having an acceptable error on the mean corresponds to a unit shipment of ferrous scrap via land transportation.

18. A method as recited in claim 11 wherein;

said reference composition specifies a maximum content, for a metallic element in said stream, which is below the mean content of said element in that part of the stream of shredded scrap metal which is upstream of said bulk sorting system;

each diverted increment is directed to a stockpile;

and the mean content of said metallic element in said stockpile of diverted increments is no greater than the maximum content specified by said reference composition.

19. A method as recited in claim 11 wherein said stream of shredded scrap metal comprises a mixture of non-ferrous scrap metal that has been separated from shredded ferrous scrap by magnetic separation and from which aluminum has been removed by another sorting procedure, said mixture comprising copper, copper-base alloys including copper-zinc alloys, and zinc-base alloys, said method comprising:

employing, as said reference composition, one or more compositions each having a zinc content within a respective one of the following ranges:

no greater than 40%, between 20% and 40%, between 10% and 20%, and no greater than 10%;

diverting said conforming increments from said stream without spacing apart the fragments of shredded scrap metal in said stream;

directing along a respective diversion path the increments conforming to a respective reference composition;

and stockpiling in a respective stockpile the increments from a respective diversion path;

whereby the increments in each stockpile may be used as feedstock for making a brass casting alloy.

20. A method as recited in claim 11 and comprising:

diverting said conforming increments without spacing apart the fragments of shredded scrap metal in said stream.

21. A method for producing, from copper-containing shredded ferrous scrap, a feedstock useful in the production of flat rolled steel, said method comprising the steps of:

providing a moving stream of shredded ferrous scrap containing copper in the form of both free copper and metallurgically incorporated copper;

conveying said moving stream along a processing path having upstream and downstream ends;

dividing said moving stream into dimensionally predetermined bulk sorting increments;

analyzing each of the dimensionally predetermined sorting increments in said moving stream to determine the copper content of the increment, as the stream undergoes movement;

diverting from said stream each increment having a copper content greater than a predetermined amount, whether said copper content is due to free copper or metallurgically incorporated copper or both;

performing said diverting step at a location on said processing path that is downstream of the location where said analyzing step is performed;

maintaining and tracking said dimensionally predetermined sorting increments downstream of said analyzing step and up to the location of said diverting step;

and accumulating the undiverted increments from said moving stream in an accumulation stockpile having a copper content less than that which could be obtained merely by removing the free copper from said stream;

the dimension, in a downstream direction, of each increment undergoing said diverting step being predetermined before that increment undergoes chemical analysis.

22. A method for producing, from shredded ferrous scrap containing metallurgically incorporated copper, a feedstock useful in the production of flat rolled steel, said method comprising:

providing a moving stream of shredded ferrous scrap that contains metallurgically incorporated copper and from which at least most of the free copper has been removed;

conveying said moving stream along a processing path having upstream and downstream ends;

dividing said moving stream into dimensionally predetermined bulk sorting increments;

analyzing each dimensionally predetermined sorting increment in said moving stream to determine the copper content of said increment, as the stream undergoes movement;

diverting from said moving stream each increment having a copper content greater than a predetermined amount and greater than the average copper content of the stream before said diverting step;

performing said diverting step at a location on said processing path that is downstream of the location where said analyzing step is performed;

maintaining and tracking said dimensionally predetermined sorting increments downstream of said analyzing step and up to the location of said diverting step;

and accumulating the undiverted increments from said moving stream in an accumulation stockpile having a copper content less than that which could be obtained merely by having removed the free copper from said stream;

the dimension, in a downstream direction, of each increment undergoing said diverting step being predetermined before that increment undergoes chemical analysis.

23. A method for sorting a stream of shredded non-ferrous scrap metal on other than piece-by-piece basis, said method comprising the steps of:

providing a moving stream of mixed, shredded, non-ferrous scrap metal;

conveying said moving stream along a processing path having upstream and downstream ends;

dividing said stream into dimensionally predetermined bulk sorting increments, each increment comprising a multiplicity of individual, unadhered fragments of shredded non-ferrous scrap metal;

analyzing each dimensionally predetermined sorting increment in said moving stream to determine its chemical composition, as the stream undergoes movement;

diverting from said stream each increment conforming to a predetermined reference composition;

performing said diverting step at a location on said processing path that is downstream of the location where said analyzing step is performed;

maintaining and tracking said dimensionally predetermined sorting increments downstream of said analyzing step and up to the location of said diverting step;

and performing said analyzing and diverting steps without spacing apart the fragments of shredded, non-ferrous scrap metal in said stream;

the dimension, in a downstream direction, of each increment undergoing said diverting step being predetermined before that increment undergoes chemical analysis.

24. A method as recited in claim 23 wherein:

said method is performed without restricting the size of the fragments of non-ferrous scrap in the increments undergoing said analyzing and diverting steps.

25. A method as recited in claim 1 wherein:

said bulk material analyzing system has an activation region with a dimension extending in the lengthwise direction of said stream;

each of said increments has a dimension extending in the lengthwise direction of said stream;

and said method comprises providing said increments with a lengthwise dimension having the same order of magnitude as the lengthwise dimension of the activation region.

26. A method as recited in claim 21 or 22 wherein:

that part of the stream which is upstream of the location where said diverting step is performed has a mean copper content greater than 0.10 wt. % and substantially less than 0.20 wt. %;

said diverted increments are directed to a stockpile for diverted increments;

and the mean copper content of said stockpile for diverted increments is at least 0.20 wt. %.

27. A method as recited in claim 26 wherein:

said stream part which is upstream of the location where said diverting step is performed has a mean copper content in the range 0.12-0.18 wt. %.

28. A method for producing, from copper-containing shredded ferrous scrap, a feedstock useful in the production of flat rolled steel, said method comprising the steps of:

providing a moving stream of shredded ferrous scrap containing copper in the form of free copper or metallurgically incorporated copper or both;

conveying said moving stream along a processing path having upstream and downstream ends;

dividing said moving stream into dimensionally predetermined bulk sorting increments;

analyzing each of the dimensionally predetermined sorting increments in said moving stream to determine the copper content of the increment, as the stream undergoes movement;

diverting from said stream each increment having a copper content less than a predetermined amount;

performing said diverting step at a location on said processing path that is downstream of the location where said analyzing step is performed;

maintaining and tracking said dimensionally predetermined sorting increments downstream of said analyzing step and up to the location of said diverting step;

accumulating the undiverted increments from said moving stream in an accumulation stockpile;

the dimension, in a downstream direction, of each increment undergoing sorting being predetermined before that increment undergoes chemical analysis;

that part of the stream which is upstream of the location where said diverting step is performed having a mean copper content greater than 0.10 wt. %;

directing said diverted increments to a stockpile for diverted increments and accumulating said increments there;

said stockpile for diverted increments having a mean copper content no greater than 0.10 wt. %.

29. A method as recited in claim 28 wherein:

that part of the stream which is upstream of the location where the diverting step is performed has a mean copper content no smaller than 0.12 wt. %.

* * * * *